US006392616B1

(12) United States Patent
Suzuki et al.

(10) Patent No.: US 6,392,616 B1
(45) Date of Patent: May 21, 2002

(54) METHOD FOR DRIVING A PLASMA DISPLAY PANEL

(75) Inventors: Masahiro Suzuki; Nobuhiko Saegusa, both of Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/519,845

(22) Filed: Mar. 6, 2000

(30) Foreign Application Priority Data

Mar. 4, 1999 (JP) ..... 11-057686

(51) Int. Cl.[7] ..... G09G 3/28

(52) U.S. Cl. ..... 345/60; 348/625; 348/537; 345/58; 345/208

(58) Field of Search ..... 345/58, 60, 63, 345/208, 690, 691

(56) References Cited

U.S. PATENT DOCUMENTS 4,129,748 A * 12/1978 Saylor ..... 348/500
5,003,228 A * 3/1991 Hada et al. ..... 315/169.4
5,926,174 A * 7/1999 Shibamiya et al. ..... 345/213
6,097,444 A * 8/2000 Nakano ..... 348/537

* cited by examiner

*Primary Examiner*—Kent Chang
*Assistant Examiner*—Ralph L. Taylor
(74) *Attorney, Agent, or Firm*—Sughrue Mion, PLLC

(57) ABSTRACT

A method for driving a plasma display panel which can perform a good image display even if a video signal having a jitter is supplied is provided. At least one of the execution time of a pixel data writing step in each sub-field, the execution time of a light emission sustaining step, and the number of sub-fields to be executed during a display period of one field is adjusted in accordance with the jitter of a vertical sync signal in the input video signal.

10 Claims, 22 Drawing Sheets

JD="0"
NO JITTER

JD="1"
JITTER EXISTS

FIG. 4

LIGHT EMISSION DRIVING PATTERN

LUMINANCE

| D | SF1 | SF2 | SF3 | SF4 | |
|---|---|---|---|---|---|
| 0000 | | | | | 0 |
| 0001 | ○ | | | | 4 |
| 0010 | | ○ | | | 8 |
| 0011 | ○ | ○ | | | 12 |
| 0100 | | | ○ | | 16 |
| 0101 | ○ | | ○ | | 20 |
| 0110 | | ○ | ○ | | 24 |
| 0111 | ○ | ○ | ○ | | 28 |
| 1000 | | | | ○ | 32 |
| 1001 | ○ | | | ○ | 36 |
| 1010 | | ○ | | ○ | 40 |
| 1011 | ○ | ○ | | ○ | 44 |
| 1100 | | | ○ | ○ | 48 |
| 1101 | ○ | | ○ | ○ | 52 |
| 1110 | | ○ | ○ | ○ | 56 |
| 1111 | ○ | ○ | ○ | ○ | 60 |

○: LIGHT EMISSION

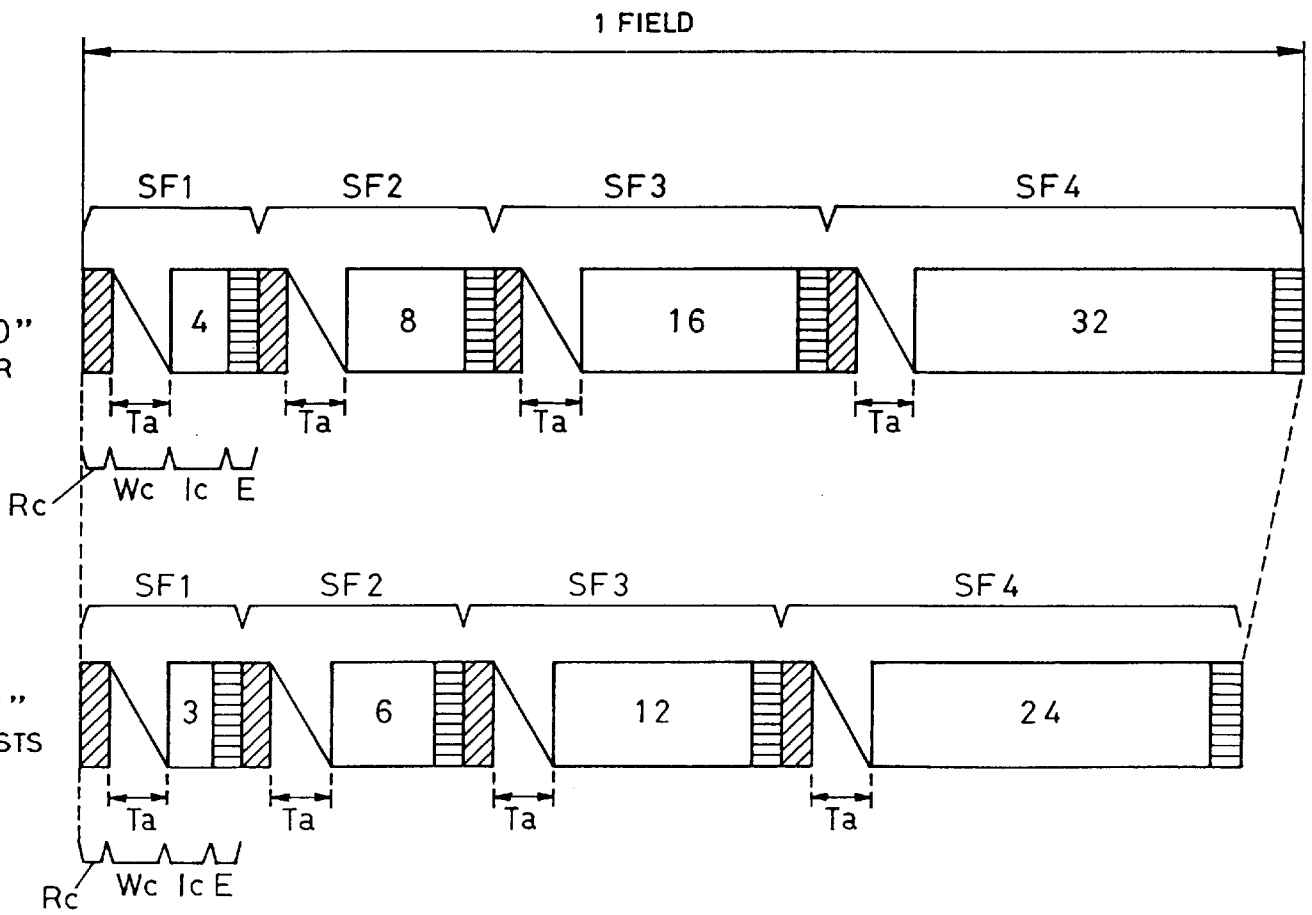
FIG.5A JD="0" NO JITTER
FIG.5B JD="1" JITTER EXISTS

JD="0"
NO JITTER

JD="1"
JITTER EXISTS

FIG.11

| LUMINANCE | DBL 0 ~ 7 | LUMINANCE | HDP 0 ~ 7 | LUMINANCE | DBL 0 ~ 7 | LUMINANCE | HDP 0 ~ 7 |
|---|---|---|---|---|---|---|---|
| 0 | 00000000 | 0 | 00000000 | 64 | 01000000 | 56 | 00111000 |
| 1 | 00000001 | 0 | 00000000 | 65 | 01000001 | 57 | 00111001 |
| 2 | 00000010 | 1 | 00000001 | 66 | 01000010 | 57 | 00111001 |
| 3 | 00000011 | 2 | 00000010 | 67 | 01000011 | 58 | 00111010 |
| 4 | 00000100 | 3 | 00000011 | 68 | 01000100 | 59 | 00111011 |
| 5 | 00000101 | 4 | 00000100 | 69 | 01000101 | 60 | 00111100 |
| 6 | 00000110 | 5 | 00000101 | 70 | 01000110 | 61 | 00111101 |
| 7 | 00000111 | 6 | 00000110 | 71 | 01000111 | 62 | 00111110 |
| 8 | 00001000 | 7 | 00000111 | 72 | 01001000 | 63 | 00111111 |
| 9 | 00001001 | 7 | 00000111 | 73 | 01001001 | 64 | 01000000 |
| 10 | 00001010 | 8 | 00001000 | 74 | 01001010 | 65 | 01000001 |
| 11 | 00001011 | 9 | 00001001 | 75 | 01001011 | 65 | 01000001 |
| 12 | 00001100 | 10 | 00001010 | 76 | 01001100 | 66 | 01000010 |
| 13 | 00001101 | 11 | 00001011 | 77 | 01001101 | 67 | 01000011 |
| 14 | 00001110 | 12 | 00001100 | 78 | 01001110 | 68 | 01000100 |
| 15 | 00001111 | 13 | 00001101 | 79 | 01001111 | 69 | 01000101 |
| 16 | 00010000 | 14 | 00001110 | 80 | 01010000 | 70 | 01000110 |
| 17 | 00010001 | 14 | 00001110 | 81 | 01010001 | 71 | 01000111 |
| 18 | 00010010 | 15 | 00001111 | 82 | 01010010 | 72 | 01001000 |
| 19 | 00010011 | 16 | 00010000 | 83 | 01010011 | 72 | 01001000 |
| 20 | 00010100 | 17 | 00010001 | 84 | 01010100 | 73 | 01001001 |
| 21 | 00010101 | 18 | 00010010 | 85 | 01010101 | 74 | 01001010 |
| 22 | 00010110 | 19 | 00010011 | 86 | 01010110 | 75 | 01001011 |
| 23 | 00010111 | 20 | 00010100 | 87 | 01010111 | 76 | 01001100 |
| 24 | 00011000 | 21 | 00010101 | 88 | 01011000 | 77 | 01001101 |
| 25 | 00011001 | 21 | 00010101 | 89 | 01011001 | 77 | 01001101 |
| 26 | 00011010 | 22 | 00010110 | 90 | 01011010 | 78 | 01001110 |
| 27 | 00011011 | 23 | 00010111 | 91 | 01011011 | 79 | 01001111 |
| 28 | 00011100 | 24 | 00011000 | 92 | 01011100 | 80 | 01010000 |
| 29 | 00011101 | 25 | 00011001 | 93 | 01011101 | 81 | 01010001 |
| 30 | 00011110 | 26 | 00011010 | 94 | 01011110 | 82 | 01010010 |
| 31 | 00011111 | 27 | 00011011 | 95 | 01011111 | 83 | 01010011 |
| 32 | 00100000 | 28 | 00011100 | 96 | 01100000 | 84 | 01010100 |
| 33 | 00100001 | 28 | 00011100 | 97 | 01100001 | 85 | 01010101 |
| 34 | 00100010 | 29 | 00011101 | 98 | 01100010 | 86 | 01010110 |
| 35 | 00100011 | 30 | 00011110 | 99 | 01100011 | 86 | 01010110 |
| 36 | 00100100 | 31 | 00011111 | 100 | 01100100 | 87 | 01010111 |
| 37 | 00100101 | 32 | 00100000 | 101 | 01100101 | 88 | 01011000 |
| 38 | 00100110 | 33 | 00100001 | 102 | 01100110 | 89 | 01011001 |
| 39 | 00100111 | 34 | 00100010 | 103 | 01100111 | 90 | 01011010 |
| 40 | 00101000 | 35 | 00100011 | 104 | 01101000 | 91 | 01011011 |
| 41 | 00101001 | 36 | 00100100 | 105 | 01101001 | 92 | 01011100 |
| 42 | 00101010 | 36 | 00100100 | 106 | 01101010 | 93 | 01011101 |
| 43 | 00101011 | 37 | 00100101 | 107 | 01101011 | 93 | 01011101 |
| 44 | 00101100 | 38 | 00100110 | 108 | 01101100 | 94 | 01011110 |
| 45 | 00101101 | 39 | 00100111 | 109 | 01101101 | 95 | 01011111 |
| 46 | 00101110 | 40 | 00101000 | 110 | 01101110 | 96 | 01100000 |
| 47 | 00101111 | 41 | 00101001 | 111 | 01101111 | 97 | 01100001 |
| 48 | 00110000 | 42 | 00101010 | 112 | 01110000 | 98 | 01100010 |
| 49 | 00110001 | 43 | 00101011 | 113 | 01110001 | 99 | 01100011 |
| 50 | 00110010 | 43 | 00101011 | 114 | 01110010 | 100 | 01100100 |
| 51 | 00110011 | 44 | 00101100 | 115 | 01110011 | 101 | 01100101 |
| 52 | 00110100 | 45 | 00101101 | 116 | 01110100 | 101 | 01100101 |
| 53 | 00110101 | 46 | 00101110 | 117 | 01110101 | 102 | 01100110 |
| 54 | 00110110 | 47 | 00101111 | 118 | 01110110 | 103 | 01100111 |
| 55 | 00110111 | 48 | 00110000 | 119 | 01110111 | 104 | 01101000 |
| 56 | 00111000 | 49 | 00110001 | 120 | 01111000 | 105 | 01101001 |
| 57 | 00111001 | 50 | 00110010 | 121 | 01111001 | 106 | 01101010 |
| 58 | 00111010 | 50 | 00110010 | 122 | 01111010 | 107 | 01101011 |
| 59 | 00111011 | 51 | 00110011 | 123 | 01111011 | 108 | 01101100 |
| 60 | 00111100 | 52 | 00110100 | 124 | 01111100 | 108 | 01101100 |
| 61 | 00111101 | 53 | 00110101 | 125 | 01111101 | 109 | 01101101 |
| 62 | 00111110 | 54 | 00110110 | 126 | 01111110 | 110 | 01101110 |
| 63 | 00111111 | 55 | 00110111 | 127 | 01111111 | 111 | 01101111 |

FIG.12

| LUMINANCE | DBL 0 ~ 7 | LUMINANCE | HDP 0 ~ 7 | LUMINANCE | DBL 0 ~ 7 | LUMINANCE | HDP 0 ~ 7 |
|---|---|---|---|---|---|---|---|
| 128 | 10000000 | 112 | 01110000 | 192 | 11000000 | 168 | 10101000 |
| 129 | 10000001 | 113 | 01110001 | 193 | 11000001 | 169 | 10101001 |
| 130 | 10000010 | 114 | 01110010 | 194 | 11000010 | 170 | 10101010 |
| 131 | 10000011 | 115 | 01110011 | 195 | 11000011 | 171 | 10101011 |
| 132 | 10000100 | 115 | 01110011 | 196 | 11000100 | 172 | 10101100 |
| 133 | 10000101 | 116 | 01110100 | 197 | 11000101 | 173 | 10101101 |
| 134 | 10000110 | 117 | 01110101 | 198 | 11000110 | 173 | 10101101 |
| 135 | 10000111 | 118 | 01110110 | 199 | 11000111 | 174 | 10101110 |
| 136 | 10001000 | 119 | 01110111 | 200 | 11001000 | 175 | 10101111 |
| 137 | 10001001 | 120 | 01111000 | 201 | 11001001 | 176 | 10110000 |
| 138 | 10001010 | 121 | 01111001 | 202 | 11001010 | 177 | 10110001 |
| 139 | 10001011 | 122 | 01111010 | 203 | 11001011 | 178 | 10110010 |
| 140 | 10001100 | 122 | 01111010 | 204 | 11001100 | 179 | 10110011 |
| 141 | 10001101 | 123 | 01111011 | 205 | 11001101 | 180 | 10110100 |
| 142 | 10001110 | 124 | 01111100 | 206 | 11001110 | 180 | 10110100 |
| 143 | 10001111 | 125 | 01111101 | 207 | 11001111 | 181 | 10110101 |
| 144 | 10010000 | 126 | 01111110 | 208 | 11010000 | 182 | 10110110 |
| 145 | 10010001 | 127 | 01111111 | 209 | 11010001 | 183 | 10110111 |
| 146 | 10010010 | 128 | 10000000 | 210 | 11010010 | 184 | 10111000 |
| 147 | 10010011 | 129 | 10000001 | 211 | 11010011 | 185 | 10111001 |
| 148 | 10010100 | 130 | 10000010 | 212 | 11010100 | 186 | 10111010 |
| 149 | 10010101 | 130 | 10000010 | 213 | 11010101 | 187 | 10111011 |
| 150 | 10010110 | 131 | 10000011 | 214 | 11010110 | 187 | 10111011 |
| 151 | 10010111 | 132 | 10000100 | 215 | 11010111 | 188 | 10111100 |
| 152 | 10011000 | 133 | 10000101 | 216 | 11011000 | 189 | 10111101 |
| 153 | 10011001 | 134 | 10000110 | 217 | 11011001 | 190 | 10111110 |
| 154 | 10011010 | 135 | 10000111 | 218 | 11011010 | 191 | 10111111 |
| 155 | 10011011 | 136 | 10001000 | 219 | 11011011 | 192 | 11000000 |
| 156 | 10011100 | 137 | 10001001 | 220 | 11011100 | 193 | 11000001 |
| 157 | 10011101 | 137 | 10001001 | 221 | 11011101 | 194 | 11000010 |
| 158 | 10011110 | 138 | 10001010 | 222 | 11011110 | 195 | 11000011 |
| 159 | 10011111 | 139 | 10001011 | 223 | 11011111 | 195 | 11000011 |
| 160 | 10100000 | 140 | 10001100 | 224 | 11100000 | 196 | 11000100 |
| 161 | 10100001 | 141 | 10001101 | 225 | 11100001 | 197 | 11000101 |
| 162 | 10100010 | 142 | 10001110 | 226 | 11100010 | 198 | 11000110 |
| 163 | 10100011 | 143 | 10001111 | 227 | 11100011 | 199 | 11000111 |
| 164 | 10100100 | 144 | 10010000 | 228 | 11100100 | 200 | 11001000 |
| 165 | 10100101 | 144 | 10010000 | 229 | 11100101 | 201 | 11001001 |
| 166 | 10100110 | 145 | 10010001 | 230 | 11100110 | 202 | 11001010 |
| 167 | 10100111 | 146 | 10010010 | 231 | 11100111 | 202 | 11001010 |
| 168 | 10101000 | 147 | 10010011 | 232 | 11101000 | 203 | 11001011 |
| 169 | 10101001 | 148 | 10010100 | 233 | 11101001 | 204 | 11001100 |
| 170 | 10101010 | 149 | 10010101 | 234 | 11101010 | 205 | 11001101 |
| 171 | 10101011 | 150 | 10010110 | 235 | 11101011 | 206 | 11001110 |
| 172 | 10101100 | 151 | 10010111 | 236 | 11101100 | 207 | 11001111 |
| 173 | 10101101 | 151 | 10010111 | 237 | 11101101 | 208 | 11010000 |
| 174 | 10101110 | 152 | 10011000 | 238 | 11101110 | 209 | 11010001 |
| 175 | 10101111 | 153 | 10011001 | 239 | 11101111 | 209 | 11010001 |
| 176 | 10110000 | 154 | 10011010 | 240 | 11110000 | 210 | 11010010 |
| 177 | 10110001 | 155 | 10011011 | 241 | 11110001 | 211 | 11010011 |
| 178 | 10110010 | 156 | 10011100 | 242 | 11110010 | 212 | 11010100 |
| 179 | 10110011 | 157 | 10011101 | 243 | 11110011 | 213 | 11010101 |
| 180 | 10110100 | 158 | 10011110 | 244 | 11110100 | 214 | 11010110 |
| 181 | 10110101 | 158 | 10011110 | 245 | 11110101 | 215 | 11010111 |
| 182 | 10110110 | 159 | 10011111 | 246 | 11110110 | 216 | 11011000 |
| 183 | 10110111 | 160 | 10100000 | 247 | 11110111 | 216 | 11011000 |
| 184 | 10111000 | 161 | 10100001 | 248 | 11111000 | 217 | 11011001 |
| 185 | 10111001 | 162 | 10100010 | 249 | 11111001 | 218 | 11011010 |
| 186 | 10111010 | 163 | 10100011 | 250 | 11111010 | 219 | 11011011 |
| 187 | 10111011 | 164 | 10100100 | 251 | 11111011 | 220 | 11011100 |
| 188 | 10111100 | 165 | 10100101 | 252 | 11111100 | 221 | 11011101 |
| 189 | 10111101 | 166 | 10100110 | 253 | 11111101 | 222 | 11011110 |
| 190 | 10111110 | 166 | 10100110 | 254 | 11111110 | 223 | 11011111 |
| 191 | 10111111 | 167 | 10100111 | 255 | 11111111 | 224 | 11100000 |

FIG.17

SELECTIVE ERASURE

| Ds | HD | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| 0000 | 1 | 0 | 0 | 0 | 0 | 0 | 0 | 0 | 0 | 0 | 0 | 0 | 0 | 0 |
| 0001 | 0 | 1 | 0 | 0 | 0 | 0 | 0 | 0 | 0 | 0 | 0 | 0 | 0 | 0 |
| 0010 | 0 | 0 | 1 | 0 | 0 | 0 | 0 | 0 | 0 | 0 | 0 | 0 | 0 | 0 |
| 0011 | 0 | 0 | 0 | 1 | 0 | 0 | 0 | 0 | 0 | 0 | 0 | 0 | 0 | 0 |
| 0100 | 0 | 0 | 0 | 0 | 1 | 0 | 0 | 0 | 0 | 0 | 0 | 0 | 0 | 0 |
| 0101 | 0 | 0 | 0 | 0 | 0 | 1 | 0 | 0 | 0 | 0 | 0 | 0 | 0 | 0 |
| 0110 | 0 | 0 | 0 | 0 | 0 | 0 | 1 | 0 | 0 | 0 | 0 | 0 | 0 | 0 |
| 0111 | 0 | 0 | 0 | 0 | 0 | 0 | 0 | 1 | 0 | 0 | 0 | 0 | 0 | 0 |
| 1000 | 0 | 0 | 0 | 0 | 0 | 0 | 0 | 0 | 1 | 0 | 0 | 0 | 0 | 0 |
| 1001 | 0 | 0 | 0 | 0 | 0 | 0 | 0 | 0 | 0 | 1 | 0 | 0 | 0 | 0 |
| 1010 | 0 | 0 | 0 | 0 | 0 | 0 | 0 | 0 | 0 | 0 | 1 | 0 | 0 | 0 |
| 1011 | 0 | 0 | 0 | 0 | 0 | 0 | 0 | 0 | 0 | 0 | 0 | 1 | 0 | 0 |
| 1100 | 0 | 0 | 0 | 0 | 0 | 0 | 0 | 0 | 0 | 0 | 0 | 0 | 1 | 0 |
| 1101 | 0 | 0 | 0 | 0 | 0 | 0 | 0 | 0 | 0 | 0 | 0 | 0 | 0 | 1 |
| 1110 | 0 | 0 | 0 | 0 | 0 | 0 | 0 | 0 | 0 | 0 | 0 | 0 | 0 | 0 |

JD = "0"
NO JITTER

JD = "1"
JITTER EXISTS

FIG. 20

SELECTIVE ERASURE

| HD 1 | 2 | 3 | 4 | 5 | 6 | 7 | 8 | 9 | 10 | 11 | 12 | 13 | 14 | LIGHT EMISSION DRIVING PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT EMISSION LUMINANCE |
|---|---|---|---|---|---|---|---|---|---|---|---|---|---|---|---|---|---|---|---|---|---|---|---|---|---|---|---|---|
| 1 | 0 | 0 | 0 | 0 | 0 | 0 | 0 | 0 | 0 | 0 | 0 | 0 | 0 | ● | | | | | | | | | | | | | | 0 |
| 0 | 1 | 0 | 0 | 0 | 0 | 0 | 0 | 0 | 0 | 0 | 0 | 0 | 0 | ○ | ● | | | | | | | | | | | | | 4 |
| 0 | 0 | 1 | 0 | 0 | 0 | 0 | 0 | 0 | 0 | 0 | 0 | 0 | 0 | ○ | ○ | ● | | | | | | | | | | | | 16 |
| 0 | 0 | 0 | 1 | 0 | 0 | 0 | 0 | 0 | 0 | 0 | 0 | 0 | 0 | ○ | ○ | ○ | ● | | | | | | | | | | | 36 |
| 0 | 0 | 0 | 0 | 1 | 0 | 0 | 0 | 0 | 0 | 0 | 0 | 0 | 0 | ○ | ○ | ○ | ○ | ● | | | | | | | | | | 68 |
| 0 | 0 | 0 | 0 | 0 | 1 | 0 | 0 | 0 | 0 | 0 | 0 | 0 | 0 | ○ | ○ | ○ | ○ | ○ | ● | | | | | | | | | 108 |
| 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 160 |
| 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 224 |
| 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 300 |
| 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 388 |
| 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 488 |
| 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 600 |
| 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 728 |
| 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 868 |
| 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 1024 |

BLACK CIRCLE : SELECTIVE ERASING DISCHARGE
WHITE CIRCLE : LIGHT EMISSION

JD="0"
NO JITTER

JD="1"
JITTER EXISTS

JD = "0"
NO JITTER

JD = "1"
JITTER EXISTS

FIG. 23

SELECTIVE ERASURE

| Ds | HD 1 | 2 | 3 | 4 | 5 | 6 | 7 | 8 | 9 | 10 | 11 | 12 | 13 | 14 | LIGHT EMISSION DRIVING PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT EMISSION LUMINANCE |
|---|---|---|---|---|---|---|---|---|---|---|---|---|---|---|---|---|---|---|---|---|---|---|---|---|---|---|---|---|---|
| 0000 | 1 | 1 | * | * | * | * | * | * | * | * | * | * | * | * | ● | ● | △ | △ | △ | △ | △ | △ | △ | △ | △ | △ | △ | △ | 0 |
| 0001 | 0 | 1 | 1 | * | * | * | * | * | * | * | * | * | * | * | ○ | ● | ● | △ | △ | △ | △ | △ | △ | △ | △ | △ | △ | △ | 4 |
| 0010 | 0 | 0 | 1 | 1 | * | * | * | * | * | * | * | * | * | * | ○ | ○ | ● | ● | △ | △ | △ | △ | △ | △ | △ | △ | △ | △ | 16 |
| 0011 | 0 | 0 | 0 | 1 | 1 | * | * | * | * | * | * | * | * | * | ○ | ○ | ○ | ● | ● | △ | △ | △ | △ | △ | △ | △ | △ | △ | 36 |
| 0100 | 0 | 0 | 0 | 0 | 1 | 1 | * | * | * | * | * | * | * | * | ○ | ○ | ○ | ○ | ● | ● | △ | △ | △ | △ | △ | △ | △ | △ | 68 |
| 0101 | 0 | 0 | 0 | 0 | 0 | 1 | 1 | * | * | * | * | * | * | * | ○ | ○ | ○ | ○ | ○ | ● | ● | △ | △ | △ | △ | △ | △ | △ | 108 |
| 0110 | 0 | 0 | 0 | 0 | 0 | 0 | 1 | 1 | * | * | * | * | * | * | ○ | ○ | ○ | ○ | ○ | ○ | ● | ● | △ | △ | △ | △ | △ | △ | 160 |
| 0111 | 0 | 0 | 0 | 0 | 0 | 0 | 0 | 1 | 1 | * | * | * | * | * | ○ | ○ | ○ | ○ | ○ | ○ | ○ | ● | ● | △ | △ | △ | △ | △ | 224 |
| 1000 | 0 | 0 | 0 | 0 | 0 | 0 | 0 | 0 | 1 | 1 | * | * | * | * | ○ | ○ | ○ | ○ | ○ | ○ | ○ | ○ | ● | ● | △ | △ | △ | △ | 300 |
| 1001 | 0 | 0 | 0 | 0 | 0 | 0 | 0 | 0 | 0 | 1 | 1 | * | * | * | ○ | ○ | ○ | ○ | ○ | ○ | ○ | ○ | ○ | ● | ● | △ | △ | △ | 388 |
| 1010 | 0 | 0 | 0 | 0 | 0 | 0 | 0 | 0 | 0 | 0 | 1 | 1 | * | * | ○ | ○ | ○ | ○ | ○ | ○ | ○ | ○ | ○ | ○ | ● | ● | △ | △ | 488 |
| 1011 | 0 | 0 | 0 | 0 | 0 | 0 | 0 | 0 | 0 | 0 | 0 | 1 | 1 | * | ○ | ○ | ○ | ○ | ○ | ○ | ○ | ○ | ○ | ○ | ○ | ● | ● | △ | 600 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 728 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 868 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 1024 |

* : "1" OR "0"

BLACK CIRCLE : SELECTIVE ERASING DISCHARGE
WHITE CIRCLE : LIGHT EMISSION

METHOD FOR DRIVING A PLASMA DISPLAY PANEL

BACKGROUND OF THE INVENTION

1. Field of the Invention

The invention relates to a method for driving a plasma display panel (hereinafter, simply referred to as PDP) of a matrix display scheme.

2. Description of the Related Art

In recent years, in association with the enlargement of a display apparatus, a thin type display apparatus has been requested and various thin type display apparatuses have been put into practical use. An AC (alternate current discharge) type PDP is highlighted as one type of the thin display apparatuses.

The PDP has a plurality of column electrodes (address electrodes) and a plurality of row electrodes arranged so as to cross the column electrodes. Each of the row electrode pairs and the column electrodes are covered with a dielectric material layer against a discharge space and have a structure such that a discharge cell corresponding to one pixel is formed at a cross point of the row electrode pair and the column electrode. Since the PDP performs a light emission display by using a discharge phenomenon, each of the discharge cells has only two states: namely, a state where it emits the light and a state where it does not emit the light. A sub-field method is, therefore, used to realize a halftone luminance display corresponding to an input video signal by the PDP. According to the sub-field method, a display period of one field is divided into N sub-fields, the number of light emission times corresponding to a weight of a bit digit of pixel data (N bits) according to the input video signal is allocated to each sub-field, and the light emission driving is executed.

When a jitter occurs in a vertical sync signal in the input video signal, however, there is a case where a display period of one field becomes short. In this instance, all of the N sub-fields cannot be executed within the short 1-field display period. When the video signal in which the jitter occurred in the vertical sync signal is supplied, therefore, a desired gradation luminance cannot be obtained and there is a problem of deterioration of a display image quality.

OBJECTS AND SUMMARY OF THE INVENTION

The invention is made to solve the problems and it is an object of the invention to provide a method for driving a plasma display panel in which even if a video signal having a jitter is supplied, a preferable image display is performed.

According to the invention, there is provided a method for driving a plasma display panel having discharge cells each corresponding to one pixel formed at each of intersecting points between a plurality of row electrodes arranged at respective scanning lines and a plurality of column electrodes intersecting said row electrodes, comprising the steps of: executing, in each of a plurality of sub-fields forming a display period of one field of an input video signal, a pixel data writing step and a light emission sustaining step, said pixel data writing step being to set each of said discharge cells to one of a light emitting cell and a non-light emitting cell in accordance with a pixel data based on said input video signal, said light emission sustaining step being to allow only said light emitting cells to perform a light emission by a number of times corresponding to a weight of said sub-field, in which at least one of an execution time of said pixel data writing step in each of said sub-fields, an execution time of said light emission sustaining step in each of said sub-fields, and the number of sub-fields within said display period of one field is adjusted in accordance with a jitter of a vertical sync signal in said input video signal.

BRIEF DESCRIPTION OF THE DRAWINGS

FIG. 4 is a diagram for explaining the light emission driving operation in the plasma display apparatus shown in FIG. 1;

FIGS. 5A and 5B are diagrams showing another example of a light emission driving format based on the driving method according to the invention;

FIG. 11 is a diagram showing an example of a conversion table in the first data converting circuit 32;

FIG. 12 is a diagram showing an example of a conversion table in the first data converting circuit 32;

FIG. 17 is a diagram showing all patterns of the light emission driving which is executed on the basis of the light emission driving format shown in FIG. 7;

FIG. 20 is a diagram showing all patterns of the light emission driving which is executed on the basis of the light emission driving format shown in FIGS. 18A and 18B;

FIG. 23 is a diagram showing another example of all patterns of the light emission driving which is executed on the basis of the light emission driving format shown in FIGS. 18A and 18B.

DETAILED DESCRIPTION OF THE PREFERRED EMBODIMENTS

Embodiments of the invention will now be described hereinbelow with reference to the drawings.

Figure 1:
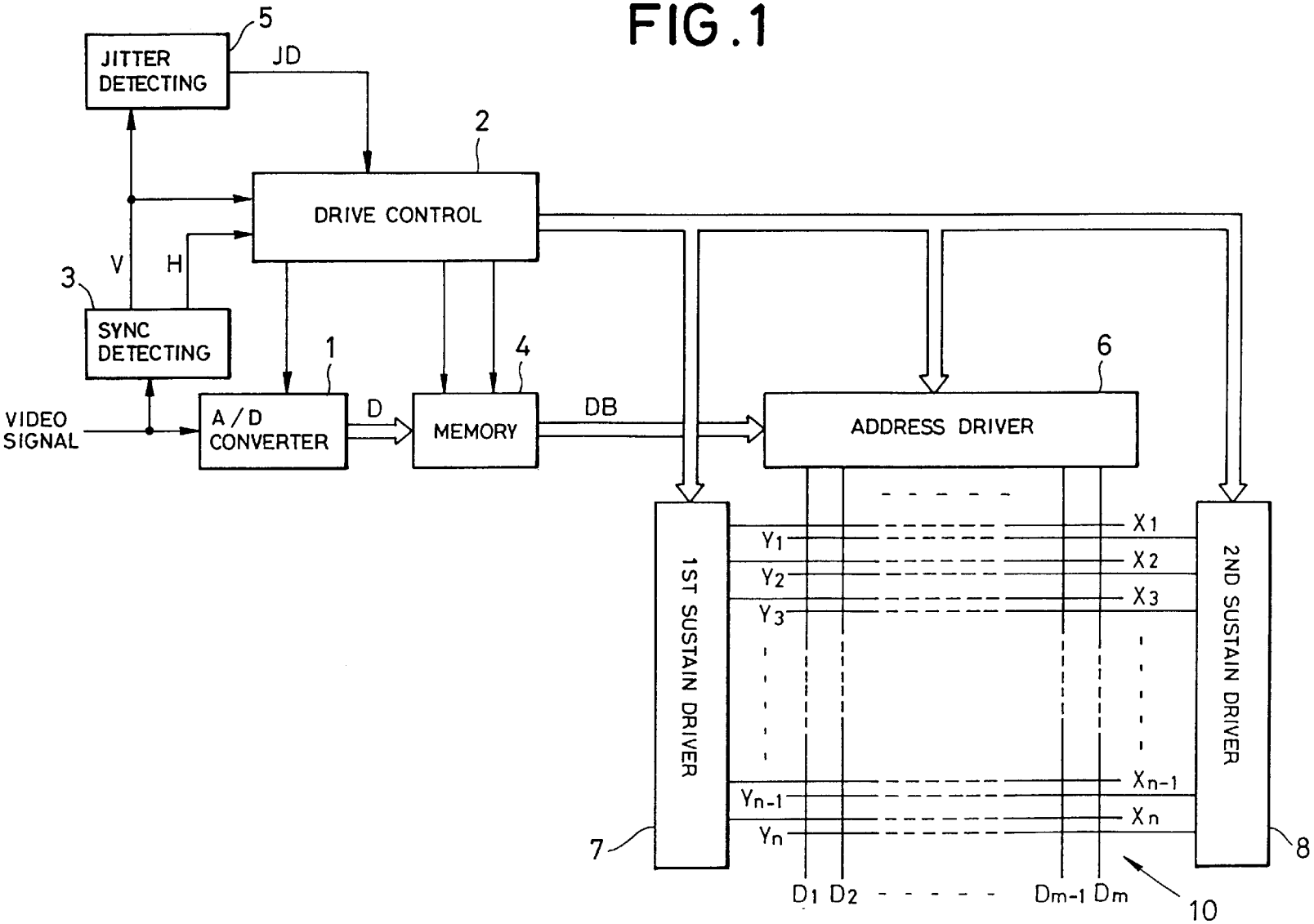
FIG. 1 is a diagram showing a schematic construction of a plasma display apparatus for light emission driving a PDP 10 on the basis of a driving method according to the invention.

FIG. 1 is a diagram showing a schematic construction of a plasma display apparatus for light emission driving a plasma display panel on the basis of a driving method according to the invention.

As shown in FIG. 1, the plasma display apparatus is constructed by: a PDP 10 as a plasma display panel; and a driving unit comprising an A/D converter 1, a drive control circuit 2, a sync detecting circuit 3, a memory 4, a jitter detecting circuit 5, an address driver 6, a first sustain driver 7, and a second sustain driver 8.

The PDP 10 has: m column electrodes $D_1$ to $D_m$ serving as address electrodes; and n row electrodes $X_1$ to $X_n$ and n row electrodes $Y_1$ to $Y_n$ arranged so as to cross the column electrodes, respectively. In this instance, the row electrodes corresponding to one row in the PDP 10 are formed by pairs of row electrodes X and row electrodes Y. The column electrodes D and the row electrodes X and Y are covered with a dielectric material layer against a discharge space and have a structure such that a discharge cell corresponding to one pixel is formed at a cross point of each row electrode pair and the column electrode.

The A/D converter 1 samples the received analog input video signal in response to a clock signal which is supplied from the drive control circuit 2, converts it to pixel data D of, for example, 4 bits corresponding to each pixel, and supplies it to the memory 4.

When the sync detecting circuit 3 detects the vertical sync signal from the input video signal, it supplies a vertical sync detection signal V to each of the drive control circuit 2 and jitter detecting circuit 5. When the sync detecting circuit 3 detects the horizontal sync signal from the input video signal, it supplies a horizontal sync detection signal H to the drive control circuit 2.

The jitter detecting circuit 5 measures a period of the vertical sync detection signal V, thereby detecting whether a jitter due to a period fluctuation has occurred in the vertical sync signal in the input video signal or not. When no jitter occurs, the jitter detecting circuit 5 supplies a jitter detection signal JD at the logic level "0" to the drive control circuit 2. When the jitter occurs, the jitter detecting circuit 5 supplies a jitter detection signal JD at the logic level "1" to the drive control circuit 2.

The drive control circuit 2 generates a clock signal to the A/D converter 1 and generates write and read signals to the memory 4 synchronously with the vertical sync detection signal V and horizontal sync detection signal H.

The memory 4 sequentially writes the pixel data D in response to the write signal supplied from the drive control circuit 2. By the writing operation, for example, when the writing of the pixel data $D_{11\text{-}nm}$ of one picture plane (n rows, m columns) in the PDP 10 is finished, the pixel data $D_{11\text{-}nm}$ of one picture plane is read out from the memory 4 every bit digit in accordance with a read signal supplied from the drive control signal 2.

That is, the pixel data $D_{11\text{-}nm}$ is divided every bit digit into $DB1_{11\text{-}nm}$: the first bit of the pixel data $D_{11\text{-}nm}$ $DB2_{11\text{-}nm}$: the second bit of the pixel data $D_{11\text{-}nm}$ $DB3_{11\text{-}nm}$: the third bit of the pixel data $D_{11\text{-}nm}$ $DB4_{11\text{-}nm}$: the fourth bit of the pixel data $D_{11\text{-}nm}$ and the divided pixel data $DB1_{11\text{-}nm}$ to $DB4_{11\text{-}nm}$ are sequentially read out every row and supplied to the address driver 6.

Figures 2A, 2B:
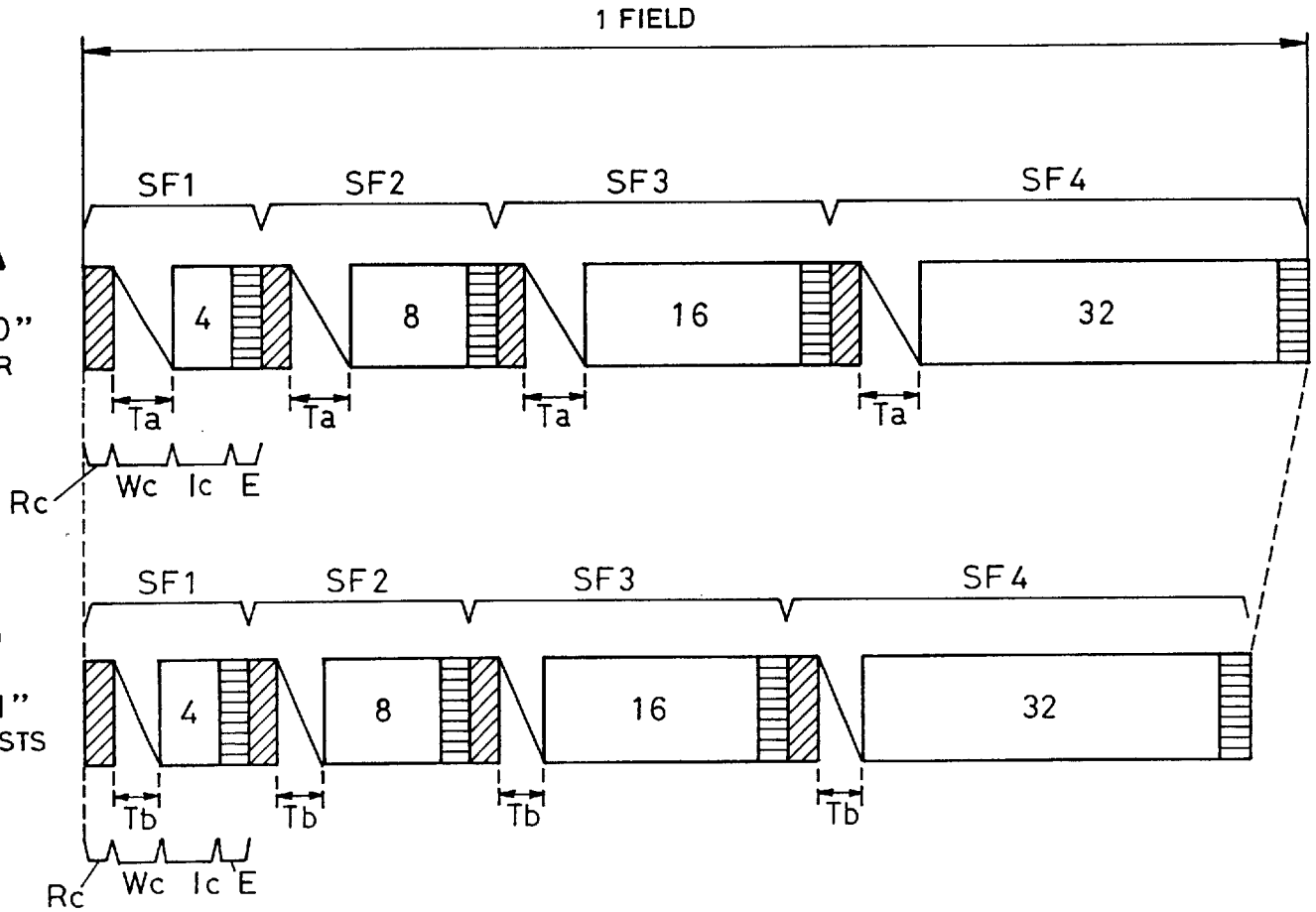
FIGS. 2A and 2B are diagrams showing an example of a light emission driving format based on the driving method according to the invention.

When the logic level of the jitter detection signal JD is equal to "0", namely, when no jitter occurs in the vertical sync signal in the input video signal, the drive control circuit 2 supplies various timing signals to drive the PDP 10 in accordance with a light emission driving format shown in FIG. 2A to the address driver 6, first sustain driver 7, and second sustain driver 8, respectively. When the logic level of the jitter detection signal JD is equal to "1", namely, if the jitter due to the period fluctuation occurred in the vertical sync signal in the input video signal, the drive control circuit 2 supplies various timing signals to drive the PDP 10 in accordance with a light emission driving format shown in FIG. 2B to the address driver 6, first sustain driver 7, and second sustain driver 8, respectively.

In the light emission driving formats shown in FIGS. 2A and 2B, a display period of one field is divided into four sub-fields comprising sub-fields SF1 to SF4 and the light emission driving is performed. In this instance, in each sub-field, an all-resetting step Rc, a pixel data writing step Wc, a light emission sustaining step Ic, and an erasing step E are executed, respectively.

Figure 3:
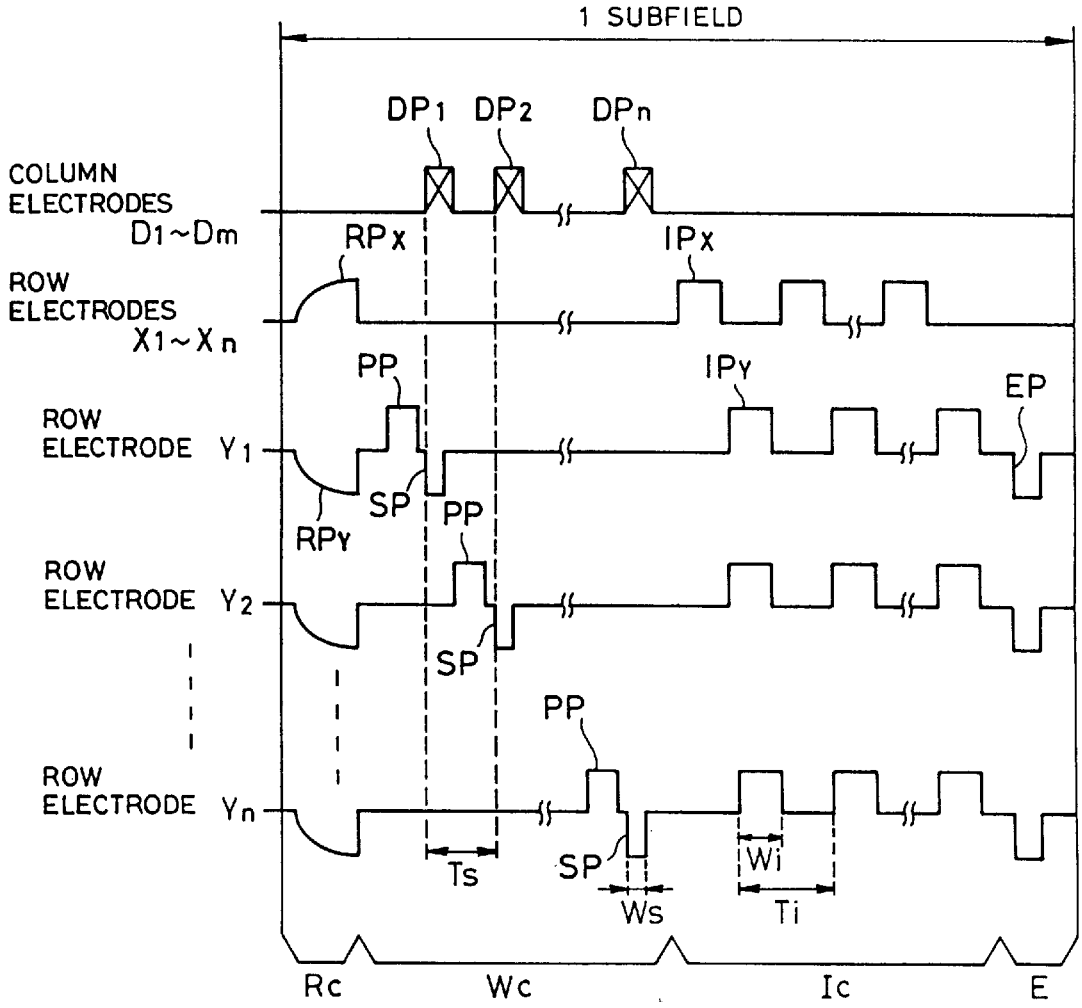
FIG. 3 is a diagram showing applying timings of various driving pulses which are applied to the PDP 10 in one sub-field.

FIG. 3 is a diagram showing applying timings (in one sub-field) of various driving pulses which are applied from the address driver 6, first sustain driver 7, and second sustain driver 8 to the column electrodes D and the row electrodes X and Y of the PDP 10 in response to the various timing signals supplied from the drive control circuit 2, respectively.

First, in the all-resetting step Rc, the first sustain driver 7 applies reset pulses $RP_x$ of a positive polarity to the row electrodes $X_1$ to $X_n$. At the same time, the second sustain driver 8 applies reset pulses $RP_Y$ of a negative polarity to the row electrodes $Y_1$ to $Y_n$. By simultaneously applying the reset pulses $RP_X$ and $RP_Y$, all of the discharge cells in the PDP 10 are reset discharged and predetermined wall charges are uniformly formed in each discharge cell. All of the discharge cells in the PDP 10, thus, are once initially set to the "light emitting cell".

In the pixel data writing step Wc, the address driver 6 allocates $DB1_{11\text{-}nm}$, $DB2_{11\text{-}nm}$ $DB3_{11\text{-}nm}$, and $DB4_{11\text{-}nm}$ supplied from the memory 4 as mentioned above to the respective sub-fields, forms pixel data pulse groups $DP_1$ to $DP_n$ having a voltage corresponding to the logic level of each bit every row, and sequentially applies them to the column electrodes $D_{1\text{-}m}$. For example, in the pixel data writing step Wc of the sub-field SF1, first, the pixel data pulse group $DP_1$ comprising pixel data pulses corresponding to the first row of $DB1_{11\text{-}nm}$, namely, m pixel data pulses corresponding to each logic level of $DB1_{11\text{-}nm}$ are formed and applied to the column electrodes $D_{1\text{-}m}$. Subsequently, the pixel data pulse group $DP_2$ comprising m pixel data pulses corresponding to each logic level of $DB1_{21\text{-}2m}$ corresponding to the second row of $DB1_{11\text{-}nm}$ are formed and simultaneously applied to the column electrodes $D_{1\text{-}m}$. In a manner similar to the above, the pixel data pulse groups $DP_3$ to $DP_n$ of each row are sequentially applied to the column electrodes $D_{1\text{-}m}$. In the pixel data writing step Wc of the sub-field SF2, the address driver 6 first forms the pixel data pulse group $DP_1$ comprising the pixel data pulses corresponding to the first row of $DB2_{11-nm}$, namely, m pixel data pulses corresponding to each logic level of $DB2_{11-nm}$ and applies them to the column electrodes $D_{1-m}$. Subsequently, the pixel data pulse group $DP_2$ comprising m pixel data pulses corresponding to each logic level of $DB2_{21-2m}$ corresponding to the second row of $DB2_{11-nm}$ are formed and simultaneously applied to the column electrodes $D_{1-m}$. In a manner similar to the above, the pixel data pulse groups $DP_3$ to $DP_n$ of each row are sequentially applied to the column electrodes $D_{1-m}$. It is assumed that when the logic level of DB is equal to "1", the address driver 6 forms the pixel data pulses of a high voltage and, when the logic level is equal to "0", it forms the pixel data pulses of a low voltage (0 volt).

The second sustain driver 8 generates scan pulses SP of a negative polarity as shown in FIG. 3 at the same timing as each applying timing of the pixel data pulse group DP as mentioned above and sequentially applies them to the row electrodes $Y_1$ to $Y_n$. In this instance, a discharge (selective erasing discharge) occurs only in the discharge cell existing in a cross portion of the "row" to which the scan pulses SP have been applied and the "column" to which the pixel data pulses of the high voltage have been applied. The wall charges remaining in the discharge cell are selectively erased. By the selective erasing discharge, the discharge cells initialized to the state of the "light emitting cell" by the all-resetting step Rc are shifted to the "non-light emitting cell". No discharge is caused in the discharge cells formed in the "column" to which the pixel data pulses of the low voltage have been applied. The state initialized by the all-resetting step Rc, namely, the state of the "light emitting cell" is maintained. Further, the second sustain driver 8 applies priming pulses PP of a positive polarity to the row electrodes $Y_1$ to $Y_n$ as shown in FIG. 3 just before the scan pulses SP are applied to each row electrode Y. A priming discharge occurs every row in response to the supply of the priming pulses PP. By the priming discharge, the charged particles reduced with the elapse of the time although they were obtained by the all-resetting operation are formed again in the discharge space of the PDP 10. Since the scan pulses SP are, therefore, applied just after the charged particles were formed again, the selective erasing discharge is certainly caused and an erroneous writing operation of the pixel data is prevented.

In a light emission sustaining step Ic, subsequently, the first sustain driver 7 and second sustain driver 8 alternately apply sustain pulses $IP_X$ and $IP_Y$ of a positive polarity to the row electrodes $X_1$ to $X_n$ and $Y_1$ to $Y_n$. In the light emission sustaining step Ic, the number of times (period) of applying the sustain pulses $IP_X$ and $IP_Y$ has been preset every sub-field SF.

For example, as shown in FIGS. 2A and 2B, now assuming that the number of light emission times in the sub-field SF1 is equal to "4", the sustain pulses $IP_X$ and $IP_Y$ are applied in the light emission sustaining step Ic of each sub-field only the following number of times (period).

SF1: 4

SF2: 8

SF3: 16

SF4: 32

By applying the sustain pulses IP, the discharge cells in which the wall charges remain in the pixel data writing step Wc, namely, the "light emitting cells" sustain discharge and perform the light emission each time the sustain pulses $IP_X$ and $IP_Y$ are applied and maintain the light emitting state only the number of times (period) allocated to each sub-field.

In an erasing step E which is executed at the end of one sub-field, the second sustain driver 8 applies erasing pulses EP of a negative polarity as shown in FIG. 3 to the row electrodes $X_1$ to $X_n$, thereby erasure discharging all of the discharge cells in a lump and erasing the wall charges remaining in each discharge cell.

The operation in one sub-field as mentioned above is executed in each of the sub-fields SF1 to SF4 in FIGS. 2A and 2B, thereby performing the light emission driving in which halftone luminance of 15 stages as shown in FIG. 4 can be expressed. For example, when a value of the pixel data D corresponding to the input video signal is equal to "0101", the light emission by the sustain discharge occurs only in the light emission sustaining step Ic in each of the sub-fields SF1 and SF3 among the sub-fields SF1 to SF4. The luminance display corresponding to "20" as a total number of "4" and "16" as the numbers of light emission times of both of them is performed.

In the plasma display apparatus shown in FIG. 1, when no jitter occurs in the vertical sync signal in the input video signal, the light emission driving format shown in FIG. 2A is used. When the jitter exists, the light emission driving format shown in FIG. 2B is used. That is, when the jitter occurs in the vertical sync signal in the input video signal, for example, as shown in FIG. 3, by shortening an applying period Ts and/or a pulse width Wi of the scan pulses, an execution time Tb in each pixel data writing step Wc is set to be shorter than a time Ta in the case where no jitter occurs as shown in FIG. 2A. When the jitter occurs in the vertical sync signal, consequently, the time that is required in the whole pixel data writing step Wc is reduced, so that the driving time that is required for display of one field is also reduced. The applying period and pulse width of the pixel data pulse DP are also controlled in accordance with the jitter in the vertical sync signal in a manner similar to the case of the scan pulses SP.

Even if the display period of one field becomes short since the jitter occurs in the input video signal, therefore, the driving time in one field is adjusted in the shortening direction from FIG. 2A to FIG. 2B in response to it. All of the sub-fields SF1 to SF4, thus, can be executed within the 1-field period.

Although the execution time of the pixel data writing step Wc of each sub-field is adjusted in accordance with the jitter in the embodiment, the execution time of the light emission sustaining step Ic can be also adjusted in place of the pixel data writing step Wc.

FIGS. 5A and 5B are diagrams showing another example of a light emission driving format made in consideration of the above point.

As shown in FIG. 5B, when the jitter occurs in the vertical sync signal in the input video signal, the number of times of light emission which is executed in the light emission sustaining step Ic of each sub-field, namely, the number of applying times of the sustain pulses $IP_X$ and $IP_Y$ is set to be smaller than that in the case where no jitter occurs as shown in FIG. 5A, thereby shortening the driving period of one field.

Although the number of times of light emission which is executed in each light emission sustaining step Ic is adjusted in the embodiment shown in FIGS. 5A and 5B, an applying period Ti and/or the pulse width Wi of the sustain pulse can be also adjusted in place of the number of light emission times. That is, when the jitter occurs in the vertical sync signal, as shown in FIG. 3, the applying period Ti and/or the pulse width Wi of the sustain pulse is shortened than that in the case where no jitter occurs, thereby adjusting the execution time of each light emission sustaining step Ic.

To reduce the driving period of one field, the sub-field to perform the light emission for the low luminance component can be omitted.

Figures 6A, 6B:
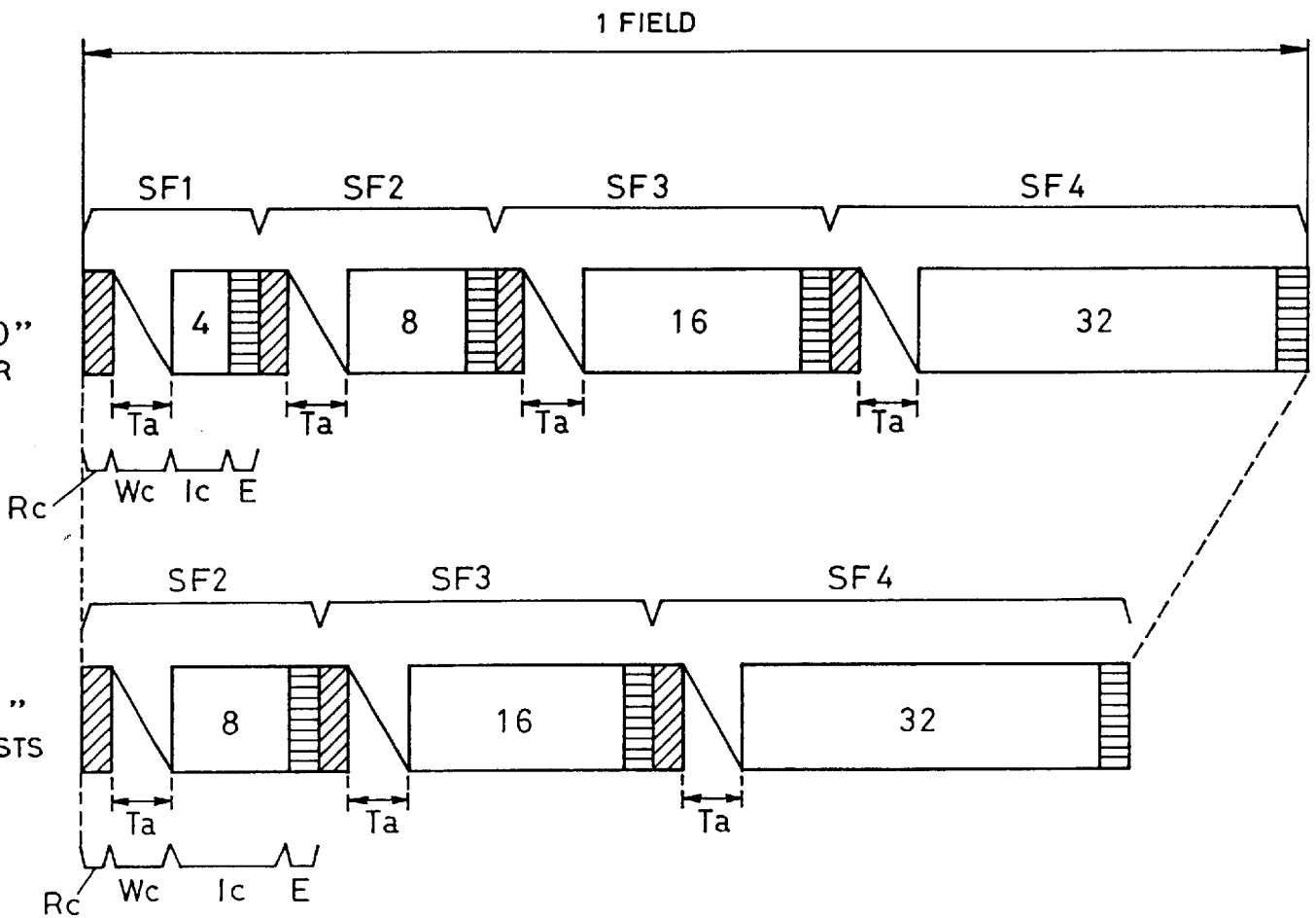
FIGS. 6A and 6B are diagrams showing another example of a light emission driving format based on the driving method according to the invention.

FIGS. 6A and 6B are diagrams showing another example of a light emission driving format made in consideration of the above point.

As shown in FIG. 6B, when the jitter occurs in the vertical sync signal in the input video signal, by omitting the light emission driving operation in the sub-field SF1 to perform the display for the low luminance component, the driving period of one field is set to a period shorter than that in the case where no jitter occurs as shown in FIG. 6A.

Although the constructions such that any of the execution time of the writing step, the execution time of the light emission sustaining step, and the number of sub-fields to be executed within the display period of one field is adjusted have been shown in the embodiments, those constructions can be also properly combined and used. In this case, the driving time that is required for display of one field is further reduced.

Although the operation has been described in the embodiment with respect to the example in the case where one field is divided into four sub-fields and the halftone luminance display is performed, the number of sub-fields to be divided is not limited to 4.

Further, although the operation in the case where the invention is applied to the light emission driving format such that each of the all-resetting step Rc, pixel data writing step Wc, light emission sustaining step Ic, and erasing step E is executed for every sub-field has been described in the embodiment, the invention is not limited to it.

Figure 7:
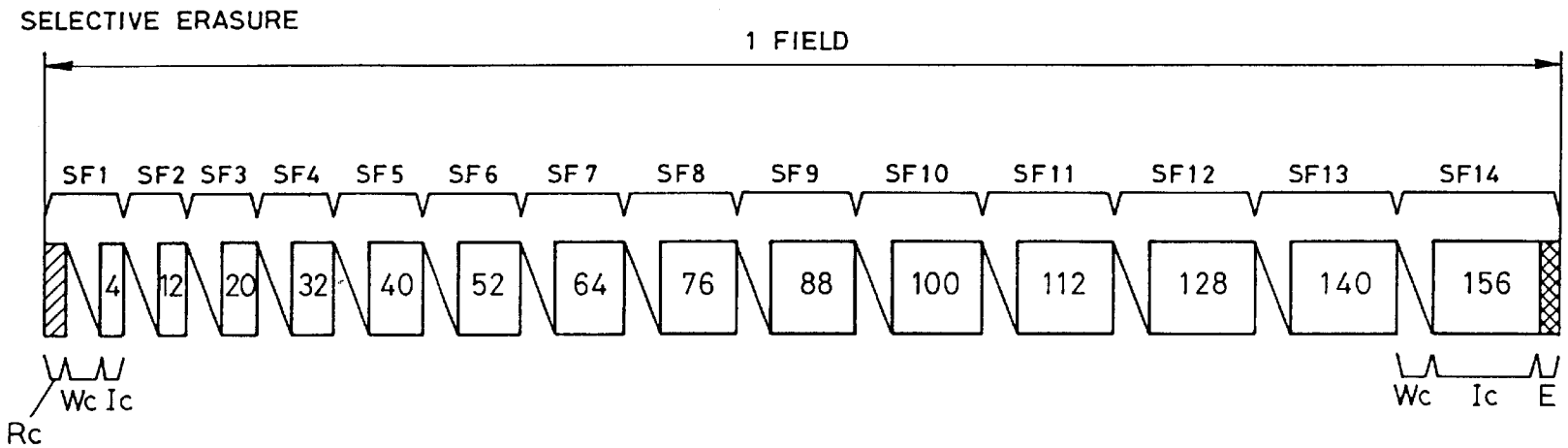
FIG. 7 is a diagram showing a light emission driving format at the time of a gradation driving in which a resetting step Rc is executed only once during a 1-field period.

For example, as shown in FIG. 7, the invention can be also applied to a light emission driving format such that the all-resetting step Rc is executed only in the head sub-field SF1 of one field and the erasing step E is executed only in the last sub-field SF14.

In the light emission driving format shown in FIG. 7, the display period of one field is divided into 14 sub-fields SF1 to SF14 and the PDP is driven. In each sub-field, the pixel data writing step Wc of writing the pixel data to each discharge cell of the PDP and setting the "light emitting cell" and the "non-light emitting cell" and the light emission sustaining step Ic of maintaining the light emitting state by allowing only the "light emitting cells" to perform the light emission only the number of times (period) shown in FIG. 7 are executed. In this instance, now assuming that the number of times of light emission which is executed in the light emission sustaining step Ic of the sub-field SF1 is set to "4", the number of times of light emission which is executed in the light emission sustaining step Ic of each sub-field is set as follows.

SF1: 4
SF2: 12
SF3: 20
SF4: 32
SF5: 40
SF6: 52
SF7: 64
SF8: 76
SF9: 88
SF10: 100
SF11: 112
SF12: 128
SF13: 140
SF14: 156

The all-resetting step Rc of initializing an amount of wall charges in all of the discharge cells of the PDP is executed only in the head sub-field SF1 and the erasing step E of erasing the wall charges in all of the discharge cells in a lump is executed only in the last sub-field SF14.

Figure 8:
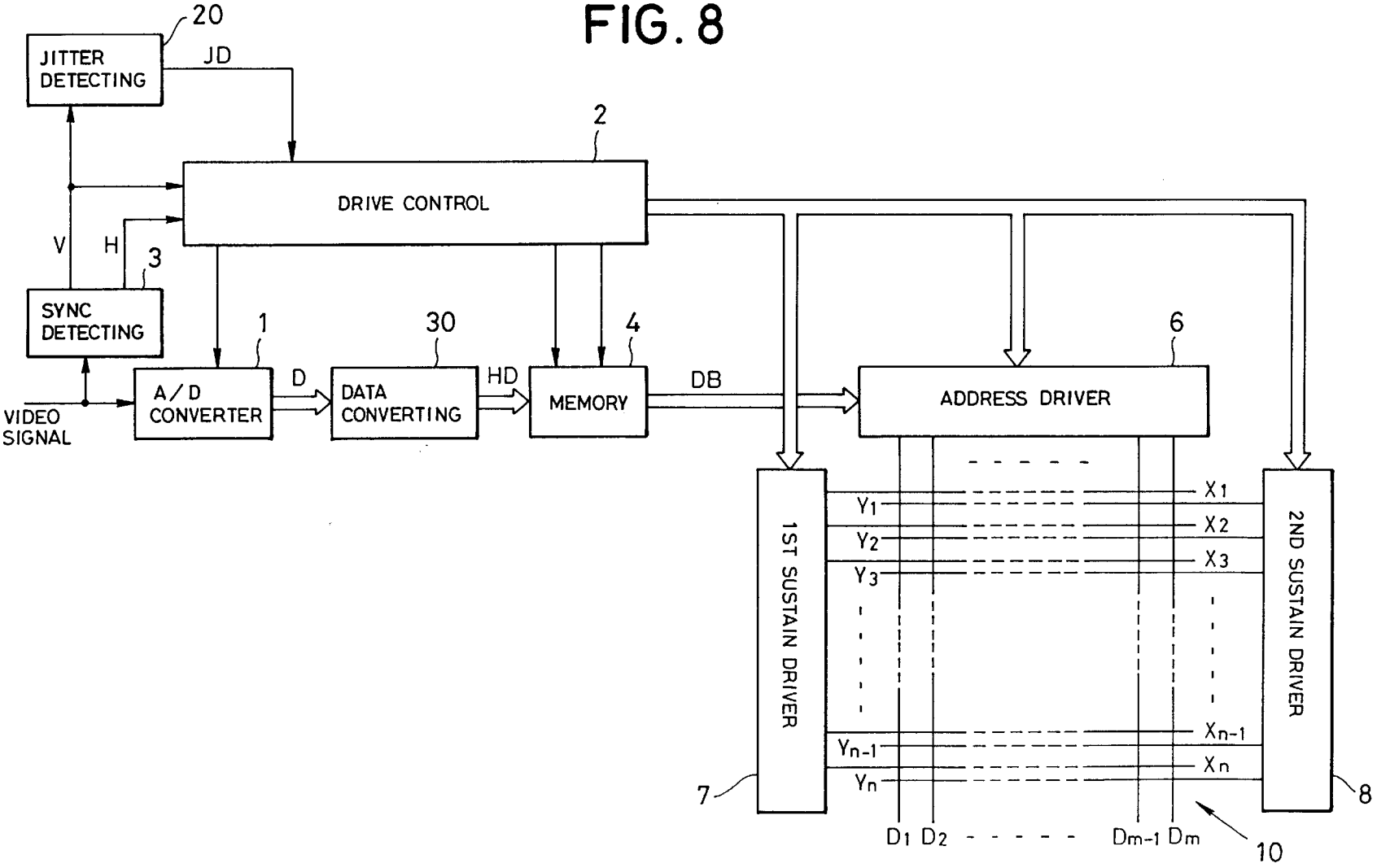
FIG. 8 is a diagram showing another construction of a plasma display apparatus for light emission driving a PDP 10 on the basis of a driving method according to the invention.

FIG. 8 is a diagram showing a construction of a plasma display apparatus for gradation driving a plasma display panel on the basis of the light emission driving format shown in FIG. 7.

As shown in FIG. 8, the plasma display apparatus is constructed by: the PDP 10 serving as a plasma display panel; and a driving unit comprising the A/D converter 1, the drive control circuit 2, the sync detecting circuit 3, a data converting circuit 30, the memory 4, the jitter detecting circuit 5, the address driver 6, the first sustain driver 7, and the second sustain driver 8.

The PDP 10 has: m column electrodes $D_1$ to $D_m$ serving as address electrodes; and n row electrodes $X_1$ to $X_n$ and n row electrodes $Y_1$ to $Y_n$ arranged so as to cross the column electrodes, respectively. In this instance, the row electrodes corresponding to one row in the PDP 10 are formed by pairs of row electrodes X and row electrodes Y. The column electrodes D and the row electrodes X and Y are covered with a dielectric material layer against a discharge space and have a structure such that a discharge cell corresponding to one pixel is formed at a cross point of each row electrode pair and the column electrode.

The A/D converter 1 samples the received analog input video signal in response to the clock signal which is supplied from the drive control circuit 2, converts it to the pixel data D of, for example, 8 bits corresponding to each pixel, and supplies it to the data converting circuit 30.

The data converting circuit 30 converts the pixel data D of 8 bits to conversion pixel data HD of 14 bits for actually driving the PDP 10 and supplies it to the memory 4.

Figure 9:
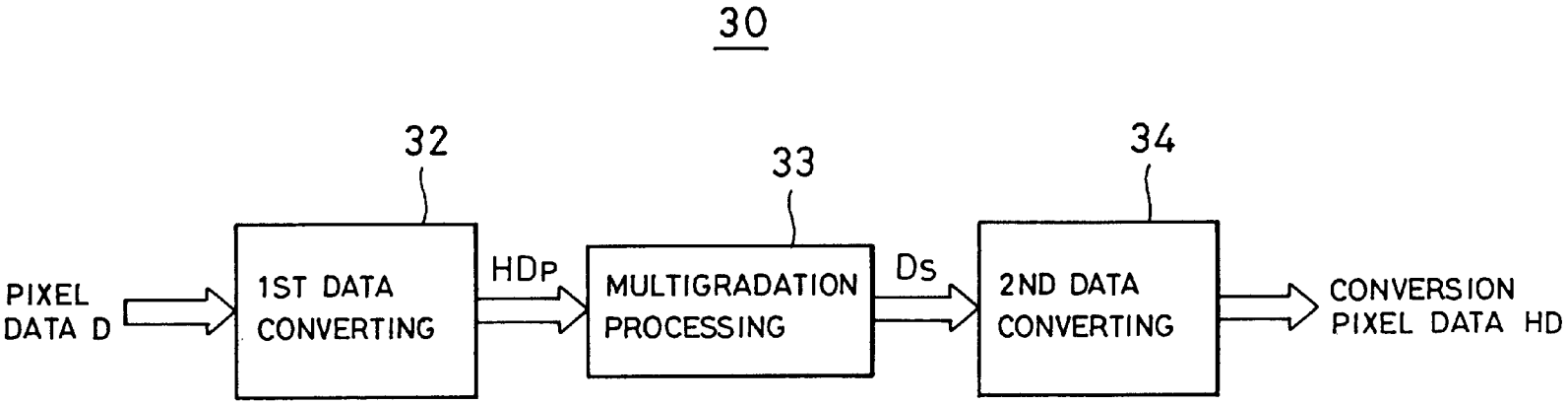
FIG. 9 is a diagram showing an internal construction of a data converting circuit 30.

FIG. 9 is a diagram showing an internal construction of the data converting circuit 30.

Figure 10:
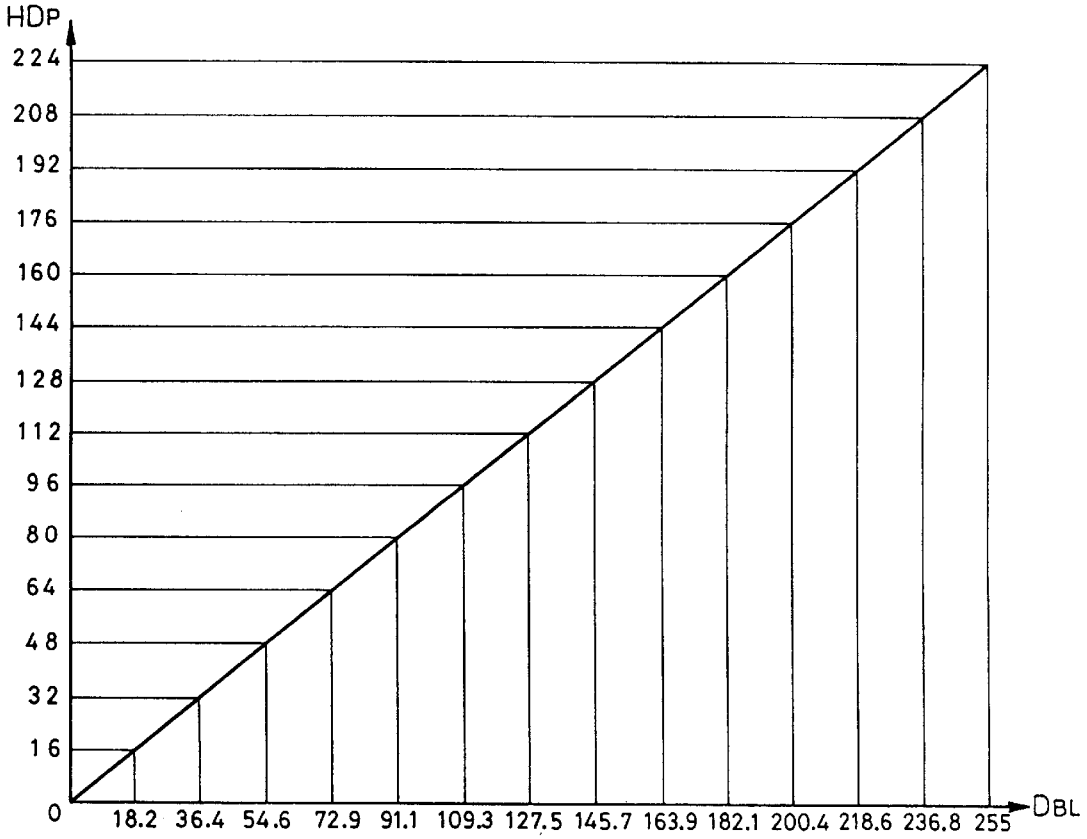
FIG. 10 is a diagram showing converting characteristics in a first data converting circuit 32.

In FIG. 9, a first data converting circuit 32 converts the 8-bit pixel data D of each pixel which is sequentially supplied from the A/D converter 1 to conversion pixel data HDP of 8 bits (0~224) by performing a conversion of (14×16)/255 on the basis of converting characteristics as shown in FIG. 10 and supplies it to a multi-gradation processing circuit 33. Specifically speaking, the pixel data D of 8 bits (0~255) is converted in accordance with conversion tables shown in FIGS. 11 and 12 based on the converting characteristics. The converting characteristics are set in accordance with the number of bits of the pixel data D, the number of bits to be compressed by a multi-gradation process of the multi-gradation processing circuit 33, and the number of display gradations. As mentioned above, by providing the first data converting circuit 32 at the front stage of the multi-gradation process and performing the conversion in accordance with the number of display gradations and the number of compression bits due to the multi-gradation, the pixel data D is separated into a group of upper bits (corresponding to the multi-gradation pixel data) and a group of lower bits (data to be omitted: error data) at a bit boundary. The multi-gradation process by the multi-gradation processing circuit 33 is performed on the basis of this signal.

By the data conversion by the first data converting circuit 32 as mentioned above, the occurrence of luminance saturation in the multi-gradation processing circuit 33 and the occurrence of a flat portion of display characteristics (namely, the occurrence of a gradation distortion) which is caused when the display gradation does not exist at the bit boundary are prevented.

Figure 13:
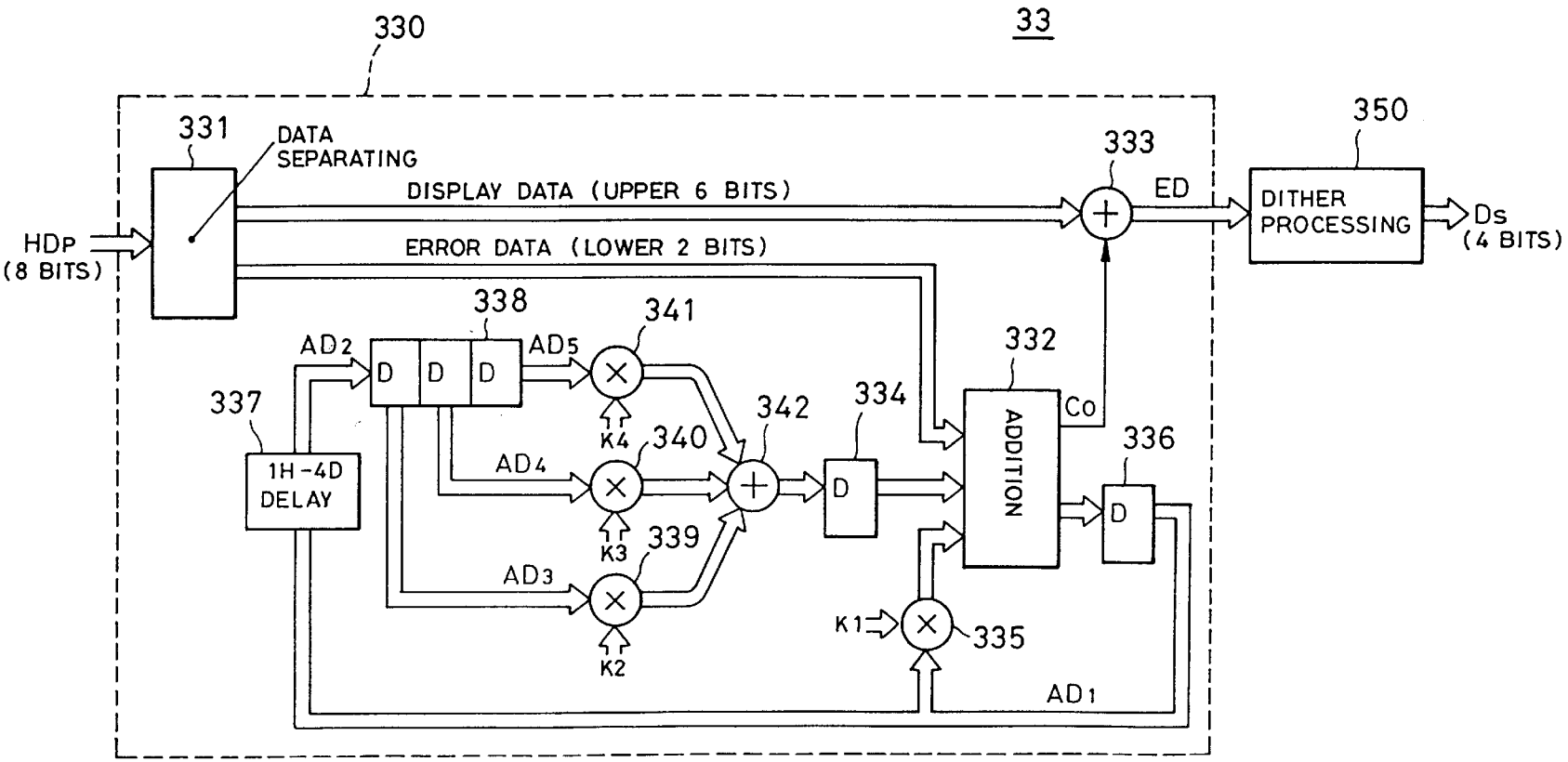
FIG. 13 is a diagram showing an internal construction of a multi-gradation processing circuit 33.

FIG. 13 is a diagram showing an internal construction of the multi-gradation processing circuit 33.

As shown in FIG. 13, the multi-gradation processing circuit 33 is constructed by an error diffusion processing circuit 330 and a dither processing circuit 350.

A data separating circuit 331 in the error diffusion processing circuit 330 separates the data of lower two bits in the 8-bit conversion pixel data $HD_P$ supplied from the first data converting circuit 32 as error data and separates the data of six upper bits as display data. An adder 332 adds the data of lower two bits in the conversion pixel data HDP as error data, a delay output from a delay circuit 334, and a multiplication output of a coefficient multiplier 335 and supplies an obtained addition value to a delay circuit 336. The delay circuit 336 delays the addition value supplied from the adder 332 by only a delay time D having the same time as the clock period of the pixel data and supplies a resultant delayed signal as a delay addition signal $AD_1$ to the coefficient multiplier 335 and a delay circuit 337, respectively. The coefficient multiplier 335 multiplies the delay addition signal $AD_1$ by a predetermined coefficient value $K_1$ (for example, "7/16") and supplies an obtained multiplication result to the adder 332. The delay circuit 337 further delays the delay addition signal $AD_1$ by only the time of (one horizontal scan period–the delay time D×4) and supplies a resultant signal as a delay addition signal $AD_2$ to a delay circuit 338. The delay circuit 338 further delays the delay addition signal $AD_2$ by only the delay time D and supplies a resultant signal as a delay addition signal $AD_3$ to a coefficient multiplier 339. The delay circuit 338 further delays the delay addition signal $AD_2$ by only the time of (the delay time D×2) and supplies an obtained signal as a delay addition signal $AD_4$ to a coefficient multiplier 340. The delay circuit 338 further delays the delay addition signal $AD_2$ by only the time of (the delay time D×3) and supplies an obtained signal as a delay addition signal $AD_5$ to a coefficient multiplier 341. The coefficient multiplier 339 multiplies the delay addition signal $AD_3$ by a predetermined coefficient value $K_2$ (for example, "3/16") and supplies an obtained multiplication result to an adder 342. The coefficient multiplier 340 multiplies the delay addition signal $AD_4$ by a predetermined coefficient value $K_3$ (for example, "5/16") and supplies an obtained multiplication result to the adder 342. The coefficient multiplier 341 multiplies the delay addition signal $AD_5$ by a predetermined coefficient value $K_4$ (for example, "1/16") and supplies an obtained multiplication result to the adder 342. The adder 342 adds multiplication results supplied from the coefficient multipliers 339, 340, and 341 and supplies an obtained addition signal to the delay circuit 334. The delay circuit 334 delays the addition signal by only a time of the delay time D and supplies the delayed signal to the adder 332. When the data of lower two bits in the conversion pixel data $HD_P$, a delay output from the delay circuit 334, and a multiplication output of the coefficient multiplier 335 are added, if there is no carry, the adder 332 generates a carry-out signal Co at the logic level "0" and supplies it to an adder 333. When there is a carry, the adder 332 generates the carry-out signal Co at the logic level "1" and supplies it to the adder 333. The adder 333 adds the carry-out signal Co to the display data consisting of upper six bits in the conversion pixel data $HD_P$ and outputs an obtained addition data as error diffusion processing pixel data ED of 6 bits. That is, the number of bits of the error diffusion processing pixel data ED is smaller than the conversion pixel data $HD_P$.

The operation of the error diffusion processing circuit 330 will now be described.

Figure 14:
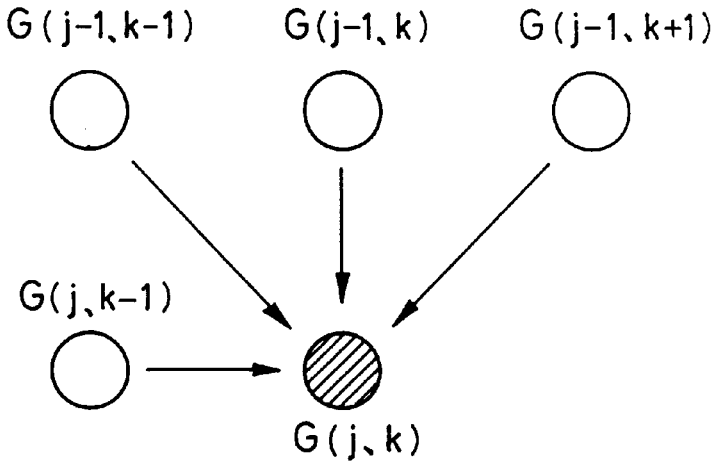
FIG. 14 is a diagram for explaining the operation of an error diffusion processing circuit 330.

For example, in case of obtaining the error diffusion processing pixel data ED corresponding to a pixel G(j,k) of the PDP 10 as shown in FIG. 14, first, error data corresponding to a pixel G(j,k−1) existing on the left side of the pixel G(j,k), a pixel G(j−1,k−1) existing at a left oblique upper position, a top pixel G(j−1,k), and a pixel G(j−1,k+1) existing at a right oblique upper position, namely, error data corresponding to the pixel G(j,k−1): delay addition signal $AD_1$ error data corresponding to the pixel G(j−1,k+1): delay addition signal $AD_3$ error data corresponding to the pixel G(j−1,k): delay addition signal $AD_4$ error data corresponding to the pixel G(j−1,k−1): delay addition signal $AD_5$ are weighted by the predetermined coefficient values $K_1$ to $K_4$ as mentioned above and resultant weighted data is added. Subsequently, the error data corresponding to the data of lower two bits of the conversion pixel data $HD_P$, namely, the error data corresponding to the pixel G(j,k) is added to the addition result. The carry-out signal Co of one bit obtained in this instance is added to the display data corresponding to the data of upper 6 bits in the conversion pixel data $HD_P$, namely, the display data corresponding to the pixel G(j,k) and resultant addition data is set to the error diffusion processing pixel data ED.

By the above construction, in the error diffusion processing circuit 330, the data of upper 6 bits in the conversion pixel data $HD_P$ is regarded as display data, the data of remaining lower two bits is regarded as error data, and the data obtained by weighting and adding the error data in the peripheral pixels {G(j,k−1), G(j−1,k+1), G(j−1,k), G(j−1,k−1)} is reflected to the display data. Since the luminance of lower 2 bits in the original pixel {G(j,k)} is falsely expressed by the peripheral pixels by the above operation, the luminance gradation expression that is substantially equivalent to that of the pixel data of 8 bits can be realized by the display data of the bits of the number smaller than 8 bits, namely, by the display data of 6 bits.

If coefficient values of the error diffusion were uniformly added to each pixel, there is a case where noises generated by an error diffusion pattern are visually confirmed, so that the picture quality is deteriorated. To prevent such a phenomenon, therefore, the error diffusion coefficients $K_1$ to $K_4$ to be allocated to the respective four pixels can be also changed every field in a manner similar to the case of dither coefficients, which will be explained hereinlater.

A dither processing circuit 350 performs a dither process to the 6-bit error diffusion processing pixel data ED supplied from the error diffusion processing circuit 330, thereby forming multi-gradation processing pixel data $D_s$ in which the number of bits is reduced to 4 bits while maintaining the luminance gradation level equivalent to that of the error diffusion processing pixel data ED. In the dither process, one intermediate display level is expressed by a plurality of neighboring pixels. For example, in case of performing the gradation display corresponding to 8 bits by using the pixel data of upper 6 bits in the 8-bit pixel data, four pixels which are neighboring at the right/left positions and the upper/lower positions are constructed as one set, four dither coefficients a to d comprising different coefficient values are allocated to the respective pixel data corresponding to the pixels of one set, and the resultant data is added. According to the dither process, combinations of four different intermediate display levels are generated with respect to four pixels. Even if the number of bits of the pixel data is equal to 6, therefore, the luminance gradation level which can be expressed can be increased four times, namely, the halftone display corresponding to 8 bits can be realized.

If the dither pattern of the dither coefficients a to d was uniformly added to each pixel, there is a case where noises generated due to the dither pattern is visually confirmed, so that the picture quality is deteriorated.

In the dither processing circuit 350, accordingly, the dither coefficients a to d to be allocated to the four pixels are changed every field.

Figure 15:
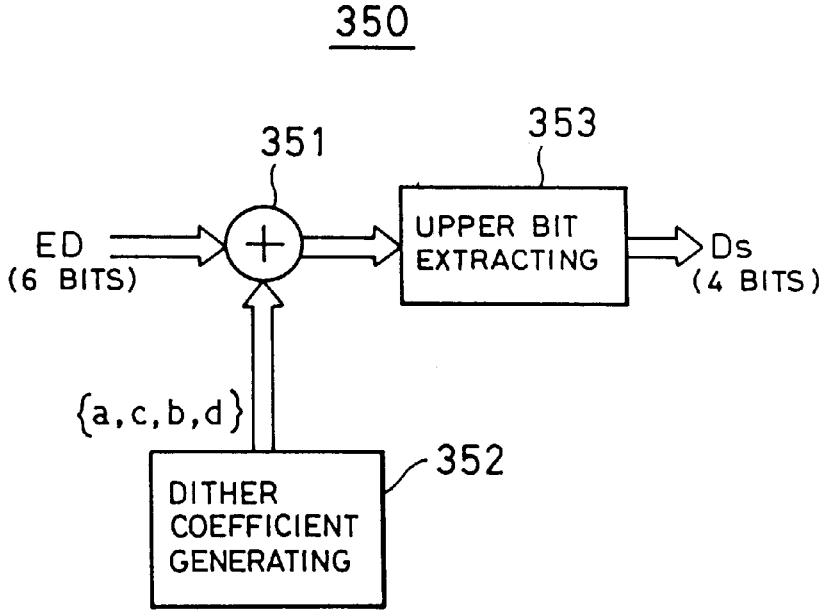
FIG. 15 is a diagram showing an internal construction of a dither processing circuit 350.

FIG. 15 is a diagram showing an internal construction of the dither processing circuit 350.

Figure 16:
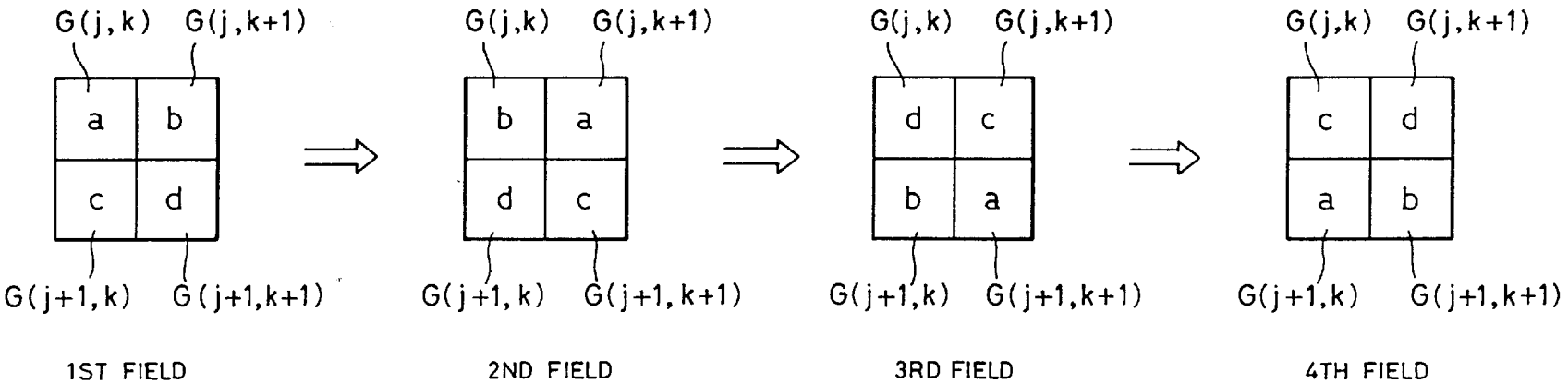
FIG. 16 is a diagram for explaining the operation of the dither processing circuit 350.

In FIG. 15, a dither coefficient generating circuit 352 generates four dither coefficients a, b, c, and d for every four adjacent pixels and sequentially supplies them to an adder 351. For example, the four dither coefficients a, b, c, and d are generated for four pixels comprising the pixels G(j,k) and G(j,k+1) corresponding to the jth row and the pixels G(j+1,k) and G(j+1,k+1) corresponding to the (j+1) throw as shown in FIG. 16. In this instance, the dither coefficient generating circuit 352 changes the dither coefficients a to d to be allocated to the four pixels every field as shown in FIG. 16.

That is, the dither coefficients a to d are cyclically and repetitively generated by allocating as follows.

In the first field, pixel G(j,k): dither coefficient a
pixel G(j,k+1):dither coefficient b
pixel G(j+1,k):dither coefficient c
pixel G(j+1,k+1): dither coefficient d In the second field, pixel G(j,k): dither coefficient b
pixel G(j,k+1):dither coefficient a
pixel G(j+1,k):dither coefficient d
pixel G(j+1,k+1): dither coefficient c In the third field, pixel G(j,k): dither coefficient d
pixel G(j,k+1):dither coefficient c
pixel G(j+1k):dither coefficient b
pixel G(j+1,k+1): dither coefficient a In the fourth field, pixel G(j,k): dither coefficient c
pixel G(j,k+1):dither coefficient d
pixel G(j+1,k):dither coefficient a
pixel G(j+1,k+1): dither coefficient b The resultant data is supplied to the adder 351. The dither coefficient generating circuit 352 repetitively executes the operations of the first to the fourth fields as mentioned above. That is, when the dither coefficient generating operation in the fourth field is finished, the operation is again returned to the operation in the first field and the foregoing operations are repeated.

The adder 351 adds the dither coefficients a to d allocated to each field as mentioned above to each of the error diffusion processing pixel data ED corresponding to each of the pixels G(j,k), G(j,k+1), G(j+1,k), and G(j+1,k+1) supplied from the error diffusion processing circuit 330, respectively, and supplies the dither addition pixel data obtained in this instance to an upper bit extracting circuit 353.

For example, in the first field shown in FIG. 16, each of the following data error diffusion processing pixel data ED corresponding to the pixel G(j,k)+dither coefficient a
error diffusion processing pixel data ED corresponding to the pixel G(j,k+1)+dither coefficient b
error diffusion processing pixel data ED corresponding to the pixel G(j+1,k)+dither coefficient c
error diffusion processing pixel data ED corresponding to the pixel G(j+1,k+1)+dither coefficient d is sequentially supplied as dither addition pixel data to the upper bit extracting circuit 353.

The upper bit extracting circuit 353 extracts the data corresponding to upper 4 bits of the dither addition pixel data and supplies it as multi-gradation pixel data $D_s$ to a second data converting circuit 34 shown in FIG. 9.

The second data converting circuit 34 converts the multi-gradation pixel data $D_s$ of 4 bits to the conversion pixel data HD of 14 bits in accordance with a conversion table as shown in FIG. 17.

As mentioned above, in the data converting circuit 30, first, by performing the error diffusion and the multi-gradation process such as a dither process to the 8-bit pixel data D, thereby obtaining the multi-gradation pixel data $D_s$ in which the number of bits is reduced to 4 bits while maintaining the number of gradations of the luminance on the sense of sight. Subsequently, the multi-gradation pixel data $D_s$ is converted to the 14-bit conversion pixel data HD for actually driving the PDP 10 in accordance with the conversion table as shown in FIG. 17.

The 14-bit conversion pixel data HD converted and outputted by the data converting circuit 30 is sequentially written in the memory 4 in response to the write signal supplied from the drive control circuit 2. When the writing of the conversion pixel data $HD_{11\text{-}nm}$ as much as one picture plane (n rows, m columns) is finished by the writing operation, the conversion pixel data $HD_{11\text{-}nm}$ of one picture plane is divided every bit digit, namely, $DB1_{11\text{-}nm}$: the 1st bit of the conversion pixel data $HD_{11\text{-}nm}$
$DB2_{11\text{-}nm}$: the 2nd bit of the conversion pixel data $HD_{11\text{-}nm}$
$DB3_{11\text{-}nm}$: the 3rd bit of the conversion pixel data $HD_{11\text{-}nm}$
$DB4_{11\text{-}nm}$: the 4th bit of the conversion pixel data $HD_{11\text{-}nm}$
$DB5_{11\text{-}nm}$: the 5th bit of the conversion pixel data $HD_{11\text{-}nm}$
$DB6_{11\text{-}nm}$: the 6th bit of the conversion pixel data $HD_{11\text{-}nm}$
$DB7_{11\text{-}nm}$: the 7th bit of the conversion pixel data $HD_{11\text{-}nm}$
$DB8_{11\text{-}nm}$: the 8th bit of the conversion pixel data $HD_{11\text{-}nm}$
$DB9_{11\text{-}nm}$: the 9th bit of the conversion pixel data $HD_{11\text{-}nm}$
$DB10_{11\text{-}nm}$: the 10th bit of the conversion pixel data $HD_{11\text{-}nm}$
$DB11_{11\text{-}nm}$: the 11th bit of the conversion pixel data $HD_{11\text{-}nm}$
$DB12_{11\text{-}nm}$: the 12th bit of the conversion pixel data $HD_{11\text{-}nm}$
$DB13_{11\text{-}nm}$: the 13th bit of the conversion pixel data $HD_{11\text{-}nm}$
$DB14_{11\text{-}nm}$: the 14th bit of the conversion pixel data $HD_{11\text{-}nm}$ each of $DB1_{11\text{-}nm}$, $DB2_{11\text{-}nm}$, . . . , $DB14_{11\text{-}nm}$ is sequentially read out every row from the memory 4 in response to the read signal supplied from the drive control circuit 2 and is supplied to the address driver 6.

Figures 18A, 18B:
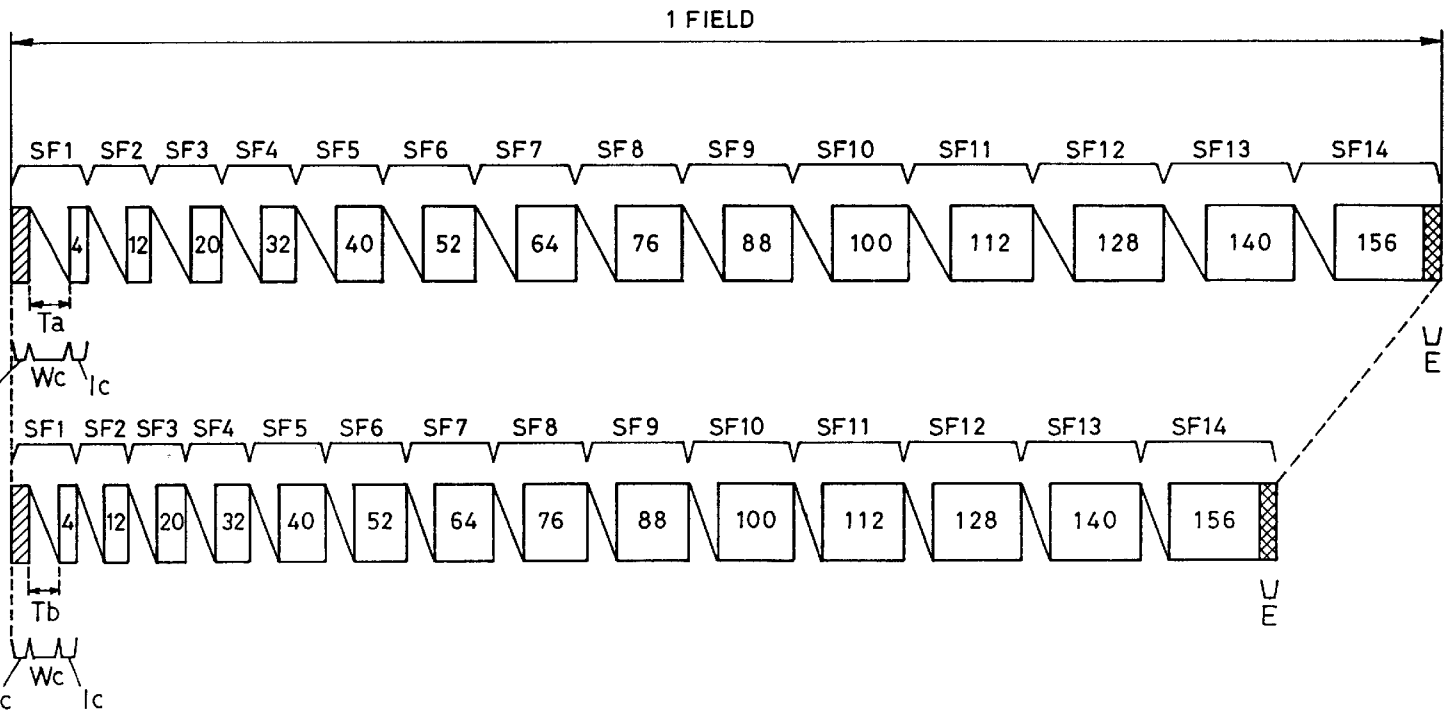
FIGS. 18A and 18B are diagrams showing an example of a light emission driving format which is used in the plasma display apparatus shown in FIG. 8.

When the logic level of the jitter detection signal JD supplied from the jitter detecting circuit 5 is equal to "0", namely, when no jitter occurs in the vertical sync signal in the input video signal, the drive control circuit 2 supplies various timing signals for driving the PDP 10 in accordance with a light emission driving format shown in FIG. 18A to the address driver 6, first sustain driver 7, and second sustain driver 8, respectively. When the logic level of the jitter detection signal JD is equal to "1", namely, when the jitter occurs in the vertical sync signal in the input video signal, the drive control circuit 2 supplies various timing signals for driving the PDP 10 in accordance with a light emission driving format shown in FIG. 18B to the address driver 6, first sustain driver 7, and second sustain driver 8, respectively. The light emission driving format shown in FIG. 18A is the same as that shown in FIG. 7 mentioned above.

Figure 19:
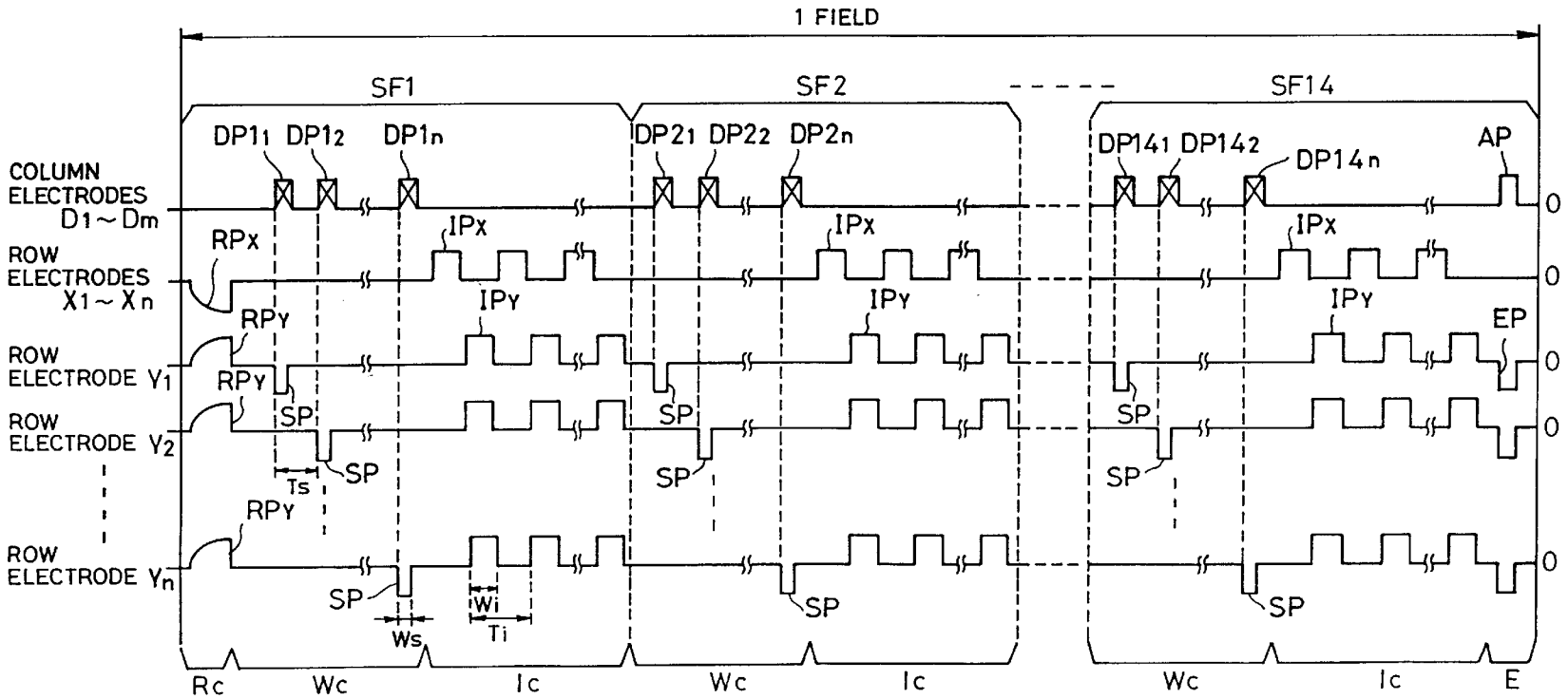
FIG. 19 is a diagram showing applying timings of various driving pulses which are applied to the PDP 10 of the plasma display apparatus shown in FIG. 8.

FIG. 19 is a diagram showing applying timings (in one field) of various driving pulses which are applied to the column electrodes D and row electrodes X and Y of the PDP 10 from the address driver 6, first sustain driver 7, and second sustain driver 8 in response to the various timing signals supplied from the drive control circuit 2, respectively.

In FIG. 19, first, in the all-resetting step Rc which is executed only in the sub-field SF1, the reset pulses $RP_X$ of a negative polarity and the reset pulses $RP_Y$ of a positive polarity as shown in the diagram are simultaneously applied to the row electrodes $X_1$ to $X_n$ and $Y_1$ to $Y_n$. The first sustain driver 7 and second sustain driver 8 apply the reset pulses $RP_X$ and $RP_Y$, all of the discharge cells in the PDP 10 are reset discharged and predetermined wall charges are uniformly formed in each discharge cell. All of the discharge cells in the PDP 10, consequently, are once initially set to the "light emitting cells".

In the pixel data writing step Wc in each sub-field, the address driver 6 generates the pixel data pulse groups $DP1_{11\text{-}nm}$ to $DP14_{11\text{-}nm}$ having the voltages corresponding to the logic levels from each of $DB1_{11\text{-}nm}$ to $DB14_{11\text{-}nm}$ supplied from the memory as mentioned above. The address driver 6 allocates each of the pixel data pulse groups $DP1_{11\text{-}nm}$ to $DP14_{11\text{-}nm}$ to the sub-fields SF1 to SF14, respectively, and sequentially applies them one row by one to the column electrodes $D_{1\text{-}m}$ every sub-field. For example, in the pixel data writing step Wc of the sub-field SF1, first, the data corresponding to the first row, namely, $DB1_{11\text{-}nm}$ are extracted from $DB1_{11\text{-}nm}$ and the pixel data pulse group $DP1_1$ comprising the m pixel data pulses corresponding to the logic level of each of $DB1_{11\text{-}nm}$ are formed and applied to the column electrodes $D_{1\text{-}m}$. Subsequently, $DB1_{21\text{-}2m}$ corresponding to the second row of $DB1_{11\text{-}nm}$ are extracted and the pixel data pulse group $DP1_2$ comprising the m pixel data pulses corresponding to the logic level of each of $DB1_{21\text{-}m2}$ are formed and simultaneously applied to the column electrodes $D_{1\text{-}m}$. In a manner similar to the above, in the pixel data writing step Wc of the sub-field SF1, the pixel data pulse groups $DP1_3$ to $DP1_n$ of every row are sequentially applied to the column electrodes $D_{1\text{-}m}$. It is assumed that when the logic level of DB1 is equal to, for example, "1", the address driver 6 forms pixel data pulses of a high voltage and, when the logic level of DB1 is equal to "0", the address driver 6 forms pixel data pulses of a low voltage (0 volt). In the pixel data writing step Wc of the sub-field SF2, first, the data corresponding to the first row, namely, $DB2_{11\text{-}1m}$ are extracted from $DB2_{11\text{-}nm}$ and the pixel data pulse group $DP2_1$ comprising the m pixel data pulses corresponding to the logic level of each of $DB2_{11\text{-}nm}$ are formed and applied to the column electrodes $D_{1\text{-}m}$. Subsequently, $DB2_{21\text{-}2m}$ corresponding to the second row of $DB2_{11\text{-}nm}$ are extracted and the pixel data pulse group $DP2_2$ comprising the m pixel data pulses corresponding to the logic level of each of $DB2_{21\text{-}2m}$ are formed and simultaneously applied to the column electrodes $D_{1\text{-}m}$. In a manner similar to the above, in the pixel data writing step Wc of the sub-field SF2, the pixel data pulse groups $DP2_3$ to $DP2_n$ of every row are sequentially applied to the column electrodes $D_{1\text{-}m}$.

Even in the pixel data writing step Wc of each of the sub-fields SF3 to SF14, the address driver 6 forms pixel data pulse groups $DP3_{1\text{-}n}$ to $DP14_{1\text{-}n}$ from each of $DB3_{11\text{-}nm}$ to $DB14_{11\text{-}nm}$ and sequentially applies them every row to the column electrodes $D_{1\text{-}m}$ in a manner similar to that of the foregoing method.

The second sustain driver 8 generates scan pulses SP of a negative polarity as shown in FIG. 19 at the same timing as each applying timing of the pixel data pulse group DP as mentioned above and sequentially applies them to the row electrodes $Y_1$ to $Y_n$. In this instance, a discharge (selective erasing discharge) occurs only in the discharge cell existing in a cross portion of the "row" to which the scan pulses SP have been applied and the "column" to which the pixel data pulses of the high voltage have been applied. The wall charges remaining in the discharge cell are selectively erased. By the selective erasing discharge, the discharge cells initialized to the state of the "light emitting cell" by the all-resetting step Rc are shifted to the "non-light emitting cell". No discharge is caused in the discharge cells formed in the "column" to which the pixel data pulses of the low voltage have been applied. The state initialized by the all-resetting step Rc, namely, the state of the "light emitting cell" is maintained.

In the light emission sustaining step Ic in each sub-field, subsequently, the first sustain driver 7 and second sustain driver 8 alternately apply sustain pulses $IP_X$ and $IP_Y$ of a positive polarity to the row electrodes $X_1$ to $X_n$ and $Y_1$ to $Y_n$. In the light emission sustaining step Ic in each sub-field, the number of times (period) of applying the sustain pulses $IP_X$ and $IP_Y$ has been preset every sub-field SF. That is, as shown in FIGS. 18A and 18B, now assuming that the number of times of light emission which is executed in the sub-field SF1 is set to "4", the sustain pulses $IP_X$ and $IP_Y$ are applied in the light emission sustaining step Ic in each sub-field only the following number of times of light emission (period).

SF1: 4
SF2: 12
SF3: 20
SF4: 32
SF5: 40
SF6: 52
SF7: 64
SF8: 76
SF9: 88
SF10: 100
SF11: 112
SF12: 128
SF13: 140
SF14: 156

By applying the sustain pulses IP, the discharge cells whose wall charges remain in the pixel data writing step Wc, namely, the "light emitting cells" sustain discharge each time the sustain pulses $IP_X$ and $IP_Y$ are applied and maintain the discharge light emitting state only the number of times (period) allocated every sub-field. According to the light emission sustaining step Ic of the sub-field SF1, therefore, the light emission display for the low luminance component of the input video signal is performed and, according to the light emission sustaining step Ic of the sub-field SF14, the light emission display for the high luminance component is performed.

As shown in FIG. 19, the erasing step E which is executed only in the last sub-field SF14, the address driver 6 generates erasing pulses AP and applies them to each of the column electrodes $D_{1\text{-}m}$. The second sustain driver 8 generates the erasing pulses EP simultaneously with the applying timings of the erasing pulses AP and applies them to each of the row electrodes $Y_1$ to $Y_n$. By simultaneously applying the erasing pulses AP and EP, the erasing discharge is caused in all of the discharge cells in the PDP 10 and the wall charges remaining in all of the discharge cells are extinguished. That is, all of the discharge cells in the PDP 10 become the "non-light emitting cells" by the erasing discharge.

By executing the operation of one field as mentioned above, the light emission driving which can express the halftone luminance of 15 stages according to each of the conversion pixel data HD comprising total 15 patterns as shown in FIG. 17 is performed.

FIG. 20 is a diagram showing the whole pattern of the light emission driving within the 1-field display period which is executed in accordance with each of the conversion pixel data HD.

A black circle shown in FIG. 20 denotes that the selective erasing discharge is executed in the pixel data writing step Wc in the sub-field. That is, the wall charges formed in all of the discharge cells of the PDP 10 by the all-resetting step Rc in the head sub-field SF1 continuously remain for a period of time until the selective erasing discharge is executed. The sustain discharge accompanied with the light emission is caused (shown by a white circle) in the light emission sustaining step Ic in each of the sub-fields existing during this period of time. As mentioned above, each discharge cell becomes the "light emitting cell" for a period of time until the selective erasing discharge is performed in one field and repeats the light emission only the number of times corresponding to each sub-field in the light emission sustaining step Ic in each sub-field existing during this interval.

According to the light emission driving pattern as shown in FIG. 20, therefore, the gradation driving of 15 stages in which the light emission luminance ratios are set to

{0, 4, 16, 36, 68, 108, 160, 224, 300, 388, 488, 600, 728, 868, 1024} are executed.

The pixel data D which is supplied from the A/D converter 1, however, expresses the halftones of 8 bits, namely, 256 stages. To realize the halftone luminance display near 256 stages, therefore, even in the gradation driving of 15 stages, the error diffusion and the multi-gradation process such as a dither are executed by the multi-gradation processing circuit 33.

In the plasma display apparatus shown in FIG. 8, as mentioned above, when no jitter occurs in the vertical sync signal in the input video signal, the light emission driving format shown in FIG. 18A is used, and when the jitter exists, the light emission driving format shown in FIG. 18B is used.

That is, when the jitter occurs in the vertical sync signal in the input video signal, by shortening the applying period Ts and/or the pulse width Wi of the scan pulses SP as shown in FIG. 19, the execution time Tb that is required for the pixel data writing step Wc of each sub-field is adjusted to the time shorter than the execution time Ta in the case where no jitter occurs, thereby shortening the driving time that is required for display of one field. The applying period and the pulse width of the pixel data pulses DP are also controlled in a manner similar to the case of the scan pulses SP in accordance with the jitter of the vertical sync signal.

Even if the jitter exists in the vertical sync signal in the input video signal and, accordingly, the display period of one field becomes short, therefore, the driving time is adjusted in the reducing direction from FIG. 18A to FIG. 18B in response to it. All of the driving operations of the sub-fields SF1 to SF14, thus, can be executed within the 1-field display period.

Although the execution time of the pixel data writing step Wc of each sub-field is adjusted in accordance with the jitter in the embodiments, the execution time of the light emission sustaining step Ic can be also adjusted in place of the pixel data writing step Wc.

Figures 21A, 21B:
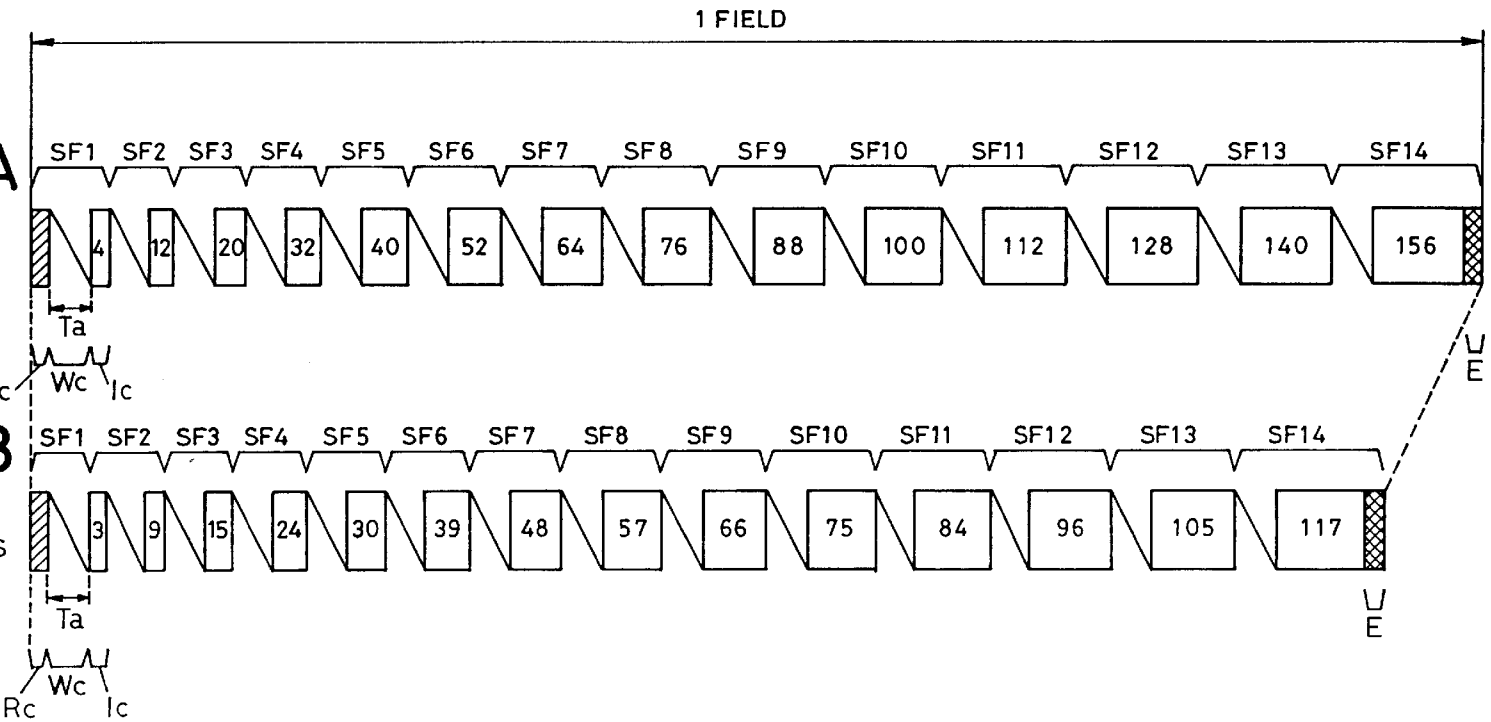
FIGS. 21A and 21B are diagrams showing another example of a light emission driving format which is used in the plasma display apparatus shown in FIG. 8.

FIGS. 21A and 21B are diagrams showing another example of a light emission driving format made in consideration of the above point.

As shown in FIG. 21B, when the jitter occurs in the vertical sync signal in the input video signal, the number of times of light emission which is executed in the light emission sustaining step Ic of each sub-field, namely, the number of applying times of the sustain pulses $IP_X$ and $IP_Y$ is set to the value smaller than that in the case where no jitter occurs as shown in FIG. 21A, thereby shortening the driving period of one field.

Although the number of times of light emission which is executed in each light emission sustaining step Ic has been adjusted in the embodiment shown in FIGS. 21A and 21B, the applying period Ti and/or the pulse width Wi of the sustain pulses can be adjusted in place of the number of light emission times. That is, when the jitter occurs in the vertical sync signal, the applying period Ti and/or the pulse width Wi of the sustain pulses is set to a value shorter than that in the case where no jitter occurs as shown in FIG. 19, thereby adjusting the execution time of each light emission sustaining step Ic.

To shorten the driving period of one field, the driving operation by the sub-field for performing the light emission for the low luminance component can be omitted.

Figures 22A, 22B:
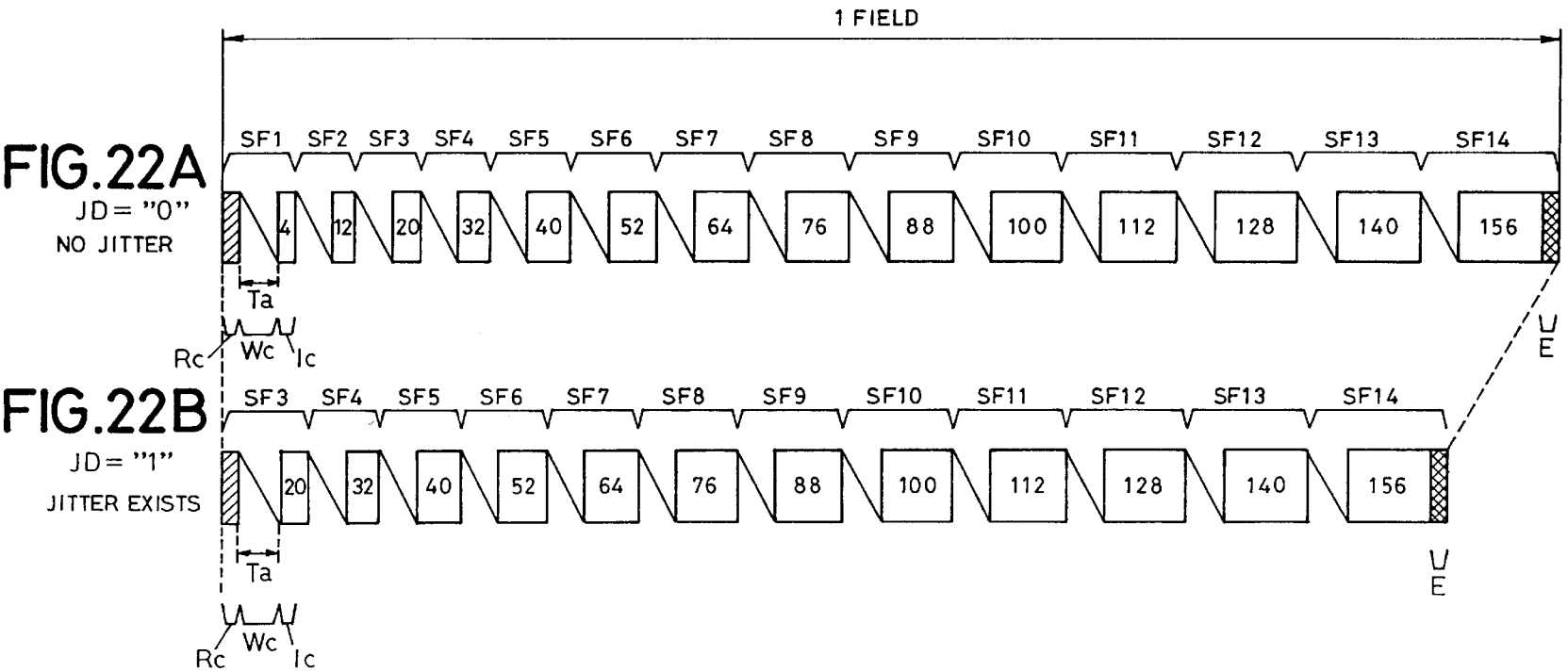
FIGS. 22A and 22B are diagrams showing another example of a light emission driving format which is used in the plasma display apparatus shown in FIG. 8.

FIGS. 22A and 22B are diagrams showing another example of light emission driving format made in consideration of the above point.

As shown in FIG. 22B, when the jitter occurs in the vertical sync signal in the input video signal, by omitting the driving operation by each of the sub-fields SF1 and SF2 to perform the display for the low luminance component, the driving period of one field is set to a value shorter than that in the case where no jitter occurs as shown in FIG. 22A.

Although the constructions such that any of the execution time of the writing step, the execution time of the light emission sustaining step, and the number of sub-fields to be executed within the display period of one field is adjusted have been shown in the embodiments, those constructions can be also properly combined and used. In this case, the driving time that is required for display of one field is further reduced.

Although the selective erasing discharge is caused in the pixel data writing step Wc of any of the sub-fields SF1 to SF4 in the driving shown in FIG. 20, if an amount of charged particles remaining in the discharge cell is small, there is a case where even if the scan pulses SP and the pixel data pulses of the high voltage are simultaneously applied, the selective erasing discharge is not normally caused.

The selective erasing discharge can be also certainly caused by using a light emission driving pattern as shown in FIG. 23 in place of the light emission driving pattern shown in FIG. 20.

In the light emission driving shown in FIG. 23, the selective erasing discharge is continuously executed (shown by black circles) in the pixel data writing step Wc of each of at least two continuous sub-fields. According to this operation, even if the wall charges in the discharge cell cannot be normally extinguished by the selective erasing discharge of the first time, the wall charges are normally extinguished by the selective erasing discharge of the second time.

As shown by Δ in FIG. 23, in any of the sub-fields after the end of the selective erasing discharge of two times, by again executing the selective erasing discharge of the third and fourth times, the wall charges are more certainly extinguished.

As described above, according to the invention, at least one of the execution time of the writing step, the execution time of the light emission sustaining step, and the number of sub-fields to be executed within the display period of one field in each sub-field is adjusted in accordance with the jitter of the vertical sync signal in the input video signal.

Even if the display period of one field becomes short because the video signal in which the jitter occurred in the vertical sync signal is inputted, the driving time is also reduced in response to it, so that all of the sub-fields can be executed within the 1-field display period. The good image display having desired gradation luminance can be performed.

What is claimed is:

1. A method for driving a plasma display panel having discharge cells each corresponding to one pixel formed at each of intersecting points between a plurality of row electrodes arranged at respective scanning lines and a plurality of column electrodes intersecting said row electrodes, comprising the steps of:

executing, in each of a plurality of sub-fields forming a display period of one field of an input video signal, a pixel data writing step and a light emission sustaining step, said pixel data writing step being to set each of said discharge cells to one of a light emitting cell and a non-light emitting cell in accordance with a pixel data based on said input video signal, said light emission sustaining step being to allow only said light emitting cells to perform a light emission by a number of times corresponding to a weight of said sub-field, in which at least one of an execution time of said pixel data writing step in each of said sub-fields, an execution time of said light emission sustaining step in each of said sub-fields, and the number of sub-fields within said display period of one field is adjusted in accordance with a jitter of a vertical sync signal in said input video signal.

2. A method according to claim 1, wherein in said pixel data writing step, a scan pulse to cause a discharge to set each of said discharge cell to one of the light emitting cell and the non-light emitting cell is sequentially applied to each of said row electrodes, and when said jitter occurs in said vertical sync signal, an applying period of said scan pulse is set to a period shorter than that in the case where said jitter does not occur, thereby adjusting the execution time of said pixel data writing step.

3. A method according to claim 1, wherein in said light emission sustaining step, sustain pulses to cause the discharge only in said light emitting cell are applied to each of said row electrodes by the number of times corresponding to the weight of said sub-field, and when said jitter occurs in said vertical sync signal, the number of applying times of said sustain pulses is set to a value smaller than that in the case where said jitter does not occur, thereby adjusting the execution time of said light emission sustaining step.

4. A method according to claim 1, wherein when said jitter occurs in said vertical sync signal, the number of sub-fields within said display period of one field is set to a value smaller than that in the case where said jitter does not occur.

5. A method for driving a plasma display panel having discharge cells each corresponding to one pixel formed at each of intersecting points between a plurality of row electrodes arranged at the respective scanning lines and a plurality of column electrodes intersecting said row electrodes, comprising the steps of:

executing, in each of a plurality of sub-fields forming a display period of one field of an input video signal, a pixel data writing step and a light emission sustaining step, said pixel data writing step being to set each of said discharge cells to one of a light emitting cell and a non-light emitting cell in accordance with a pixel data based on said input video signal, said light emission sustaining step being to allow only said light emitting cells to perform a light emission by a number of times corresponding to a weight of said sub-field, and executing, in a sub-field of a head portion in said display period of one field, a resetting step of initializing all of said discharge cells to a state of either a light emitting cell or a non-light emitting cell, in which at least one of an execution time of said pixel data writing step in each of said sub-fields, an execution time of said light emission sustaining step in each of said sub-fields, and the number of sub-fields within said display period of one field is adjusted in accordance with a jitter of a vertical sync signal in said input video signal.

6. A method according to claim 5, wherein in said pixel data writing step, a scan pulse to cause a discharge to set each of said discharge cells to one of the light emitting cell and the non-light emitting cell is sequentially applied to each of said row electrodes, and when said jitter occurs in said vertical sync signal, an applying period of said scan pulse is set to a period shorter than that in the case where said jitter does not occur, thereby adjusting the execution time of said pixel data writing step.

7. A method according to claim 5, wherein in said light emission sustaining step, sustain pulses to cause the discharge only in said light emitting cell are applied to each of said row electrodes only the number of times corresponding to a weight of said sub-field, and when said jitter occurs in said vertical sync signal, the number of applying times of said sustain pulses is set to a value smaller than that in the case where said jitter does not occur, thereby adjusting the execution time of said light emission sustaining step.

8. A method according to claim 5, wherein when said jitter occurs in said vertical sync signal, the number of sub-fields which are executed for said display period of one field is set to a value smaller than that in the case where said jitter does not occur.

9. A method according to claim 5, wherein in said pixel data writing step in one of said plurality of sub-fields, a discharge to set said discharge cell to a state of either said light emitting cell or said non-light emitting cell in accordance with said pixel data is caused, and in said pixel data writing step in at least one sub-field existing after said one sub-field, a discharge to again set said discharge cell to said one state is caused.

10. A method according to claim 5, wherein in said pixel data writing step in one of said plurality of sub-fields, a discharge to set said discharge cell to a state of either said light emitting cell or said non-light emitting cell in accordance with said pixel data is caused, and in said pixel data writing step in the sub-field existing just after said one sub-field, a discharge to again set said discharge cell to said one state is caused.

* * * * *